US010662743B2

(12) United States Patent
Twardowski et al.

(10) Patent No.: US 10,662,743 B2
(45) Date of Patent: May 26, 2020

(54) WEAR BUSHING DEPLOYMENT AND RETRIEVAL TOOL FOR SUBSEA WELLHEAD

(71) Applicant: Weatherford Technology Holdings, LLC, Houston, TX (US)

(72) Inventors: Eric M. Twardowski, Spring, TX (US); Eduardo G Valverde, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 127 days.

(21) Appl. No.: 15/892,275

(22) Filed: Feb. 8, 2018

(65) Prior Publication Data

US 2019/0242217 A1 Aug. 8, 2019

(51) Int. Cl.
*E21B 17/10* (2006.01)
*E21B 17/12* (2006.01)
(Continued)

(52) U.S. Cl.
CPC ..... *E21B 41/00* (2013.01); *E21B 17/1007* (2013.01); *E21B 17/12* (2013.01); *E21B 23/00* (2013.01); *E21B 33/03* (2013.01)

(58) Field of Classification Search
CPC ..... E21B 17/1007; E21B 17/12; E21B 33/03; E21B 41/00
See application file for complete search history.

(56) References Cited

U.S. PATENT DOCUMENTS 3,225,833 A * 12/1965 Parkhurst ..... E21B 33/043 166/207
3,473,608 A * 10/1969 Castille ..... E21B 17/1007 166/85.3

(Continued)

FOREIGN PATENT DOCUMENTS

EP 0391541 A1 10/1990
WO 20191/56701 A1 8/2019

OTHER PUBLICATIONS

Int'l Search Report and Written Opinion received in co-pending PCT Application No. PCT/US2018/066262, dated Mar. 14, 2019, 13 pages.

(Continued)

*Primary Examiner* — Matthew R Buck
(74) *Attorney, Agent, or Firm* — Blank Rome, LLP

(57) ABSTRACT

An apparatus deploys and retrieves a wear bushing in a wellhead during the same trip, such as when using a bottom hole assembly for drilling. Arms in the form of pistons, levers, dogs, etc. can be moved between retracted and extended conditions on the apparatus using actuations from remote communications. When extended, the arms engage inside the wear bushing or inside an adapter disposed in the bushing. When retracted, the arms lie within the exterior of the tool to avoid wear and damage when the drillstring is used for drilling or other operations. During deployment, the bushing supported on the extended arms is seated in the wellhead. The arms are then retracted through remote activation, and the bottom hole assembly is run further downhole. During retrieval, the retracted arms are extended through remote activation and engage in the bushing so the drillstring can lift the bushing from the wellhead.

26 Claims, 16 Drawing Sheets

(51) Int. Cl.

| | |
|---|---|
| ***E21B 23/00*** | (2006.01) |
| ***E21B 33/03*** | (2006.01) |
| ***E21B 41/00*** | (2006.01) |

(56) References Cited

U.S. PATENT DOCUMENTS

| | | | | |
|---|---|---|---|---|
| 3,489,214 | A | 1/1970 | Phipps et al. | |
| 3,645,328 | A * | 2/1972 | Greene, Jr. | E21B 17/12 166/85.3 |
| 3,901,546 | A * | 8/1975 | Piazza | E21B 33/04 294/86.15 |
| 4,109,728 | A * | 8/1978 | Sanford | E21B 17/1007 166/217 |
| 4,712,621 | A | 12/1987 | Wightman et al. | |
| 4,750,770 | A * | 6/1988 | Tibussek | E21B 7/136 294/86.15 |
| 4,995,458 | A | 2/1991 | Garbett | |
| 5,044,438 | A * | 9/1991 | Young | E21B 17/1007 166/382 |
| 5,105,888 | A | 4/1992 | Pollock et al. | |
| 6,302,211 | B1 | 10/2001 | Nelson et al. | |
| 6,719,044 | B2 * | 4/2004 | Ford | E21B 17/1007 166/301 |
| 6,749,018 | B1 | 6/2004 | Ford et al. | |
| 6,945,325 | B2 | 9/2005 | Ford et al. | |
| 7,284,616 | B2 * | 10/2007 | Williams | E21B 17/1007 166/381 |
| 7,909,107 | B2 | 3/2011 | Gette | |
| 8,322,441 | B2 * | 12/2012 | Fenton | E21B 17/1007 166/368 |
| 8,403,056 | B2 | 3/2013 | Gette et al. | |
| 8,408,309 | B2 | 4/2013 | Eppinghaus et al. | |
| 8,561,705 | B2 | 10/2013 | Wilson | |
| 8,678,093 | B2 | 3/2014 | Willoughby | |
| 9,121,238 | B2 | 9/2015 | Ellison | |
| 2002/0023748 | A1 | 2/2002 | Elliott | |
| 2012/0211280 | A1 | 8/2012 | Dewey et al. | |
| 2013/0213661 | A1 | 8/2013 | Reimert | |
| 2014/0338976 | A1 | 11/2014 | Xu et al. | |
| 2015/0101812 | A1 | 4/2015 | Bansal et al. | |

OTHER PUBLICATIONS

Int'l Search Report in counterpart PCT Appl. PCT/US2018/032801, dated Oct. 29, 2018, 4-pgs.

Written Opinion n counterpart PCT Appl. PCT/US2018/032801, dated Oct. 29, 2018, 6-pgs.

* cited by examiner

WEAR BUSHING DEPLOYMENT AND RETRIEVAL TOOL FOR SUBSEA WELLHEAD

BACKGROUND OF THE DISCLOSURE

In subsea drilling applications, a wear bushing or bore protector is typically installed inside the inner dimension of a subsea wellhead. The purpose of the wear bushing is to protect the critical inner surfaces of the wellhead. Without this protective bushing, tools in the bottom hole assembly (BHA) or the drillstring may come into contact with (and potentially damage) these critical surfaces.

Different sizes of wear bushings are typically required for different hole sections and casing sizes. Therefore, operations typically need to retrieve and run different sizes of wear bushings during the life of drilling the entire well.

For some wellhead systems, a wear bushing running/retrieval tool is not incorporated within the drilling BHA. For such systems, a dedicated trip is required to run and install the wear bushing into the subsea wellhead. Another dedicated trip is then required to retrieve the wear bushing from the subsea wellhead after a section has been drilled. Some examples of running/retrieval tools used for dedicated trips are disclosed in U.S. Pat. No. 8,561,705 and US 2013/0213661. These dedicated trips are time consuming and therefore costly in an offshore drilling environment.

These dedicated running/retrieval trips can be eliminated by using a running/retrieval tool that can be incorporated as a part of the drilling BHA. Such a tool incorporated into the drilling BHA may be used on a stabilizer sub and may have a wear sleeve supported by a bit sub running and retrieval tool. Examples of an incorporated tool include the GE Vetco BRNSP (Bit Run Nominal Seat Protector) and include the tool disclosed in U.S. Pat. No. 6,945,325.

Although running/retrieval tools incorporated into the drilling BHA may be effective, operators are always striving to improve deployment and retrieval steps and to reduce damage to the tool and other problems. To that end, the subject matter of the present disclosure is directed to overcoming, or at least reducing the effects of, one or more of the problems set forth above.

SUMMARY OF THE DISCLOSURE

An apparatus according to the present disclosure can be used for deployment and retrieval of a wear bushing in a wellhead with a drillstring. The wear bushing has a through-bore. The apparatus comprises a mandrel and a plurality of arms. The mandrel is coupled to the drillstring and is disposed in the through-bore of the wear bushing. The mandrel defines a flowbore therethrough communicating with the drillstring, and the mandrel has at least one pocket defined externally on the mandrel.

The plurality of arms is disposed on the mandrel for supporting the wear bushing on the mandrel. At least one of the arms is selectively movable in the at least one pocket between a retracted condition in the at least one pocket and an extended condition at least partially out of the at least one pocket. A distal end of the at least one movable arm in the extended condition supports the wear bushing at least in an uphole direction.

The distal end of the at least one movable arm can comprise a catch disposed on the at least one movable arm and biased to extend from the at least one movable arms. The catch on the at least one movable arm in the extended condition can support the wear bushing in the uphole direction and retracting in the downhole direction. Preferably, the catch on the at least one movable arm in the retracted condition in the pocket recesses inside an external surface of the mandrel.

The catch can comprise first surface and second surface with the first surface facing in the uphole direction and the second surface facing in the downhole direction. The first surface can support against an internal profile in the uphole direction with the catch biased to extend. However, the catch can be retractable against the bias with the second surface engaged against in the downhole direction.

In one arrangement, the at least one movable arm comprises a piston movable between the retracted and extended conditions. The mandrel can comprise at least a first hydraulic port for the piston, in which case the piston can comprises a first piston surface sealed in the pocket. The piston is movable at least from a first of the extended and retracted conditions to a second thereof with first hydraulic communication from the at least first hydraulic port against the first piston surface. Preferably, the mandrel comprises at least a second hydraulic port for the piston, and the piston preferably comprises a second piston surface sealed in the pocket. In this way, the piston is movable from the second of the extended and retracted conditions to the first thereof with second hydraulic communication from the at least second hydraulic port against the second piston surface.

The apparatus according to the present disclosure may further comprise an actuator disposed on the apparatus and actuating the at least one movable arm to selectively move between the retracted and extended conditions. For example, the actuator can be selected from the group consisting of a hydraulic actuator, a mechanical actuator, an electric actuator, an electro-mechanical actuator, and a combination thereof.

The actuator may comprise a communication component receiving remote instructions and actuating the at least one movable arm in accordance therewith. For example, the communication component can be selected from the group consisting of a mud-pulse telemetry component, a radio-frequency identification component, a controller, a sensor, a timer, and a power source.

In one configuration, the distal end of the at least one movable arm directly engages portion of the wear bushing at least in the uphole direction. In another configuration, the apparatus includes an adapter bushing disposed in the through-bore of the wear bushing. The distal end of the at least one movable arm then directly engages portion of the adapter bushing at least in the uphole direction.

For example, the adapter bushing can comprise supports engageable with portions of the wear bushing. These supports can include pins disposed in slots of the adapter bushing and engaged against the wear bushing. The adapter bushing can define one or a plurality of internal profiles in which the distal end of the at least one movable arm directly engages. The multiple internal profiles can include one or more of a J-latch profiles and a recessed relief.

The at least one movable arm may have a second downhole-facing shoulder supportable against an edge of the adapter bushing. The apparatus can include three or more of the at least one movable arms disposed circumferentially about the mandrel.

According to the present disclosure, an apparatus for deployment and retrieval of a wear bushing in a wellhead with a drillstring comprises a mandrel and a plurality of pistons. The mandrel is coupled to the drillstring and disposed in a through-bore of the wear bushing. The mandrel defines a flowbore therethrough communicating with the drillstring, and the mandrel has a plurality of pockets defined externally on the mandrel; and The plurality of pistons are disposed on the mandrel for supporting the wear bushing on the mandrel. Each of the pistons is selectively movable in one of the pockets between a retracted condition in the pocket and an extended condition at least partially out of the pocket. A distal end of the each of the pistons in the extended condition supports the wear bushing at least in an uphole direction.

Again, the distal ends of the pistons may each comprise a catch biased to extend from the piston, and the catch on the piston in the extended condition can support the wear bushing in the uphole direction and retracting in the downhole direction.

Also, each of the pistons can comprise first and second piston surfaces sealed in the pocket. The piston can be movable from the retracted condition to the extended condition with first hydraulic communication from a first hydraulic port against the first piston surface, and the piston can be movable from the extended condition to the retracted condition with second hydraulic communication from a second hydraulic port against the second piston surface.

For this apparatus, an adapter bushing can also be disposed in the through-bore of the wear bushing, and the distal ends of the pistons can directly engage portion of the adapter bushing at least in the uphole direction.

A method according to the present disclosure is for using a wear bushing in a wellhead with a drillstring. The wear bushing has a through-bore. The method comprises: deploying the wear bushing in the wellhead with the drillstring by: installing an apparatus on the drillstring; running in the wear bushing with the apparatus on the drillstring by supporting the wear bushing on a plurality of arms of the apparatus inside the through-bore of the wear bushing; landing the wear bushing in the wellhead with the apparatus on the drillstring; retracting at least one of the arms movable from an extended condition to a retracted condition on the apparatus by actuating the apparatus; and running in the drillstring and the apparatus further through the wellhead. The method further comprises retrieving the wear bushing from the wellhead with the apparatus on the drillstring.

Landing the wear bushing in the wellhead with the apparatus on the drillstring can comprise pushing down on the wear bushing with a shoulder on the at least one movable arm. Retrieving the wear bushing from the wellhead can comprises: pulling out the apparatus on the drillstring uphole of the wellhead; extending the at least one movable arm from the retracted condition to the extended condition on the apparatus by actuating the apparatus; engaging distal ends of the arms in a latch profile by running the apparatus into the wear bushing; and pulling out the wear bushing from the wellhead with the apparatus on the drillstring by supporting the wear bushing on the distal ends of the arms of the apparatus engaged with the latch profile.

Engaging the distal ends of each of the arms in the latch profile can comprises passing catches on the distal ends of the arms past an internal lip inside the wear bushing by running the apparatus into the wear bushing and biasing the catches inward past the internal lip. Alternatively, engaging the distal ends of each of the arms in the latch profile can comprise passing the distal ends of the arms through a J-latch profile inside the wear bushing by running the apparatus into the wear bushing and rotating the mandrel about the J-latch profile.

Moreover, engaging the distal ends of each of the arms in the latch profile can comprise one of: directly engaging the distal ends in the latch profile defined in the wear bushing; and engaging the distal ends in the latch profile defined in an adapter bushing disposed in the wear bushing.

Actuating the apparatus can comprise at least one of: detecting a radio frequency identification tag with the apparatus; detecting a mud pulse with a mud pulse telemetry component of the apparatus; moving the at least one of the arms in and out from the apparatus by moving a shifter longitudinally in the apparatus; and hydraulically moving the at least one of the arms in and out from the apparatus.

According to the present disclosure, a method is for using a wear bushing in a wellhead with a drillstring. The wear bushing has a through-bore with an internal lip defined thereabout. The method comprises: deploying the wear bushing in the wellhead on an apparatus with the drillstring; and retrieving the wear bushing from the wellhead by: pulling out the apparatus on a drillstring uphole of a wellhead; extending at least one movable arm of a plurality of arms from a retracted condition to an extended condition on the apparatus by actuating the apparatus; engaging distal ends of each of the arms in a latch profile by running the apparatus into the wear bushing; and pulling out the wear bushing from the wellhead with the apparatus on the drillstring by supporting the wear bushing on the distal ends of the arms of the apparatus.

The foregoing summary is not intended to summarize each potential embodiment or every aspect of the present disclosure.

DETAILED DESCRIPTION OF THE DISCLOSURE

Figure 1A:
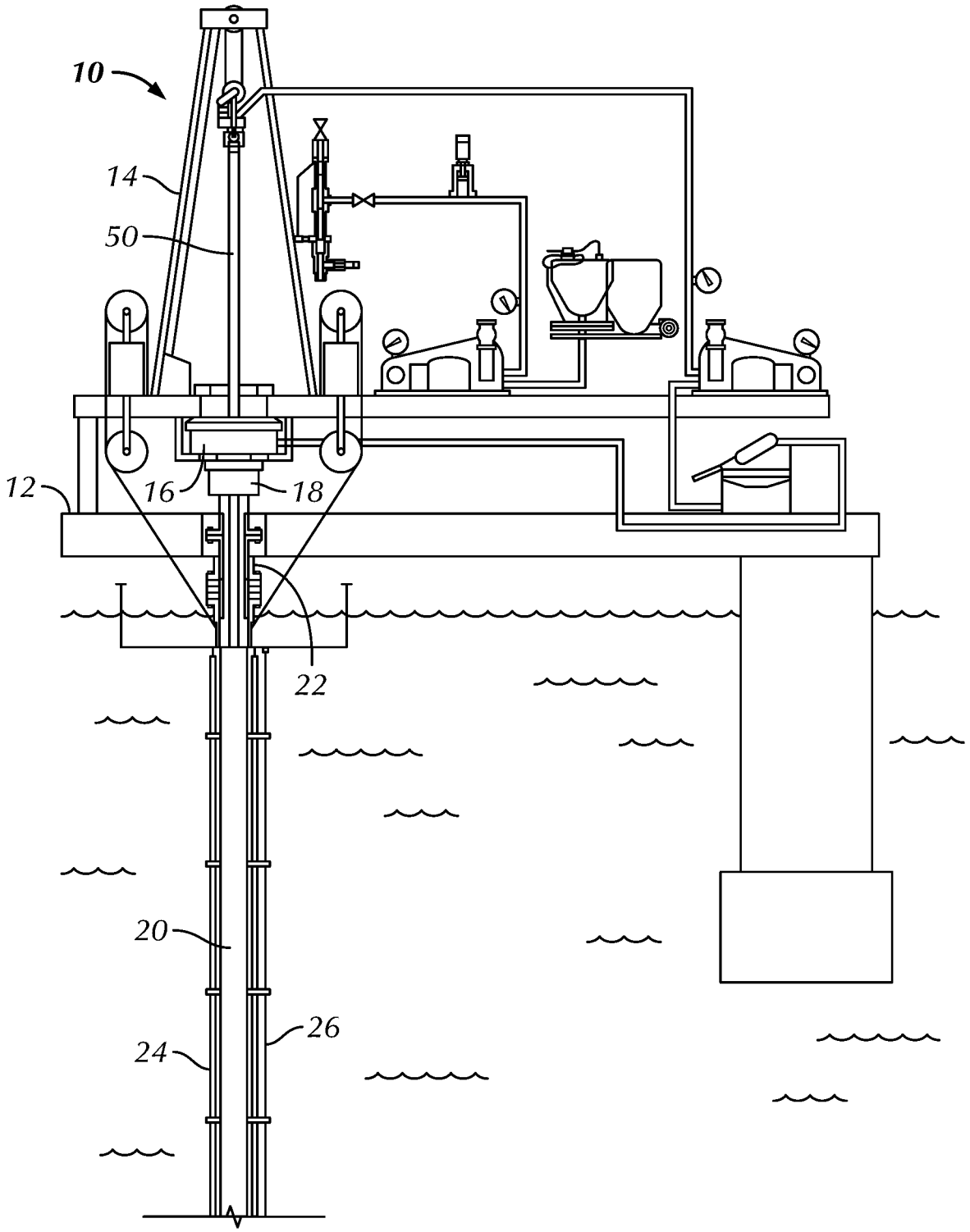
FIGS. 1A-1B illustrate a drilling system deploying a wear bushing according to the present disclosure.
Figure 1B:
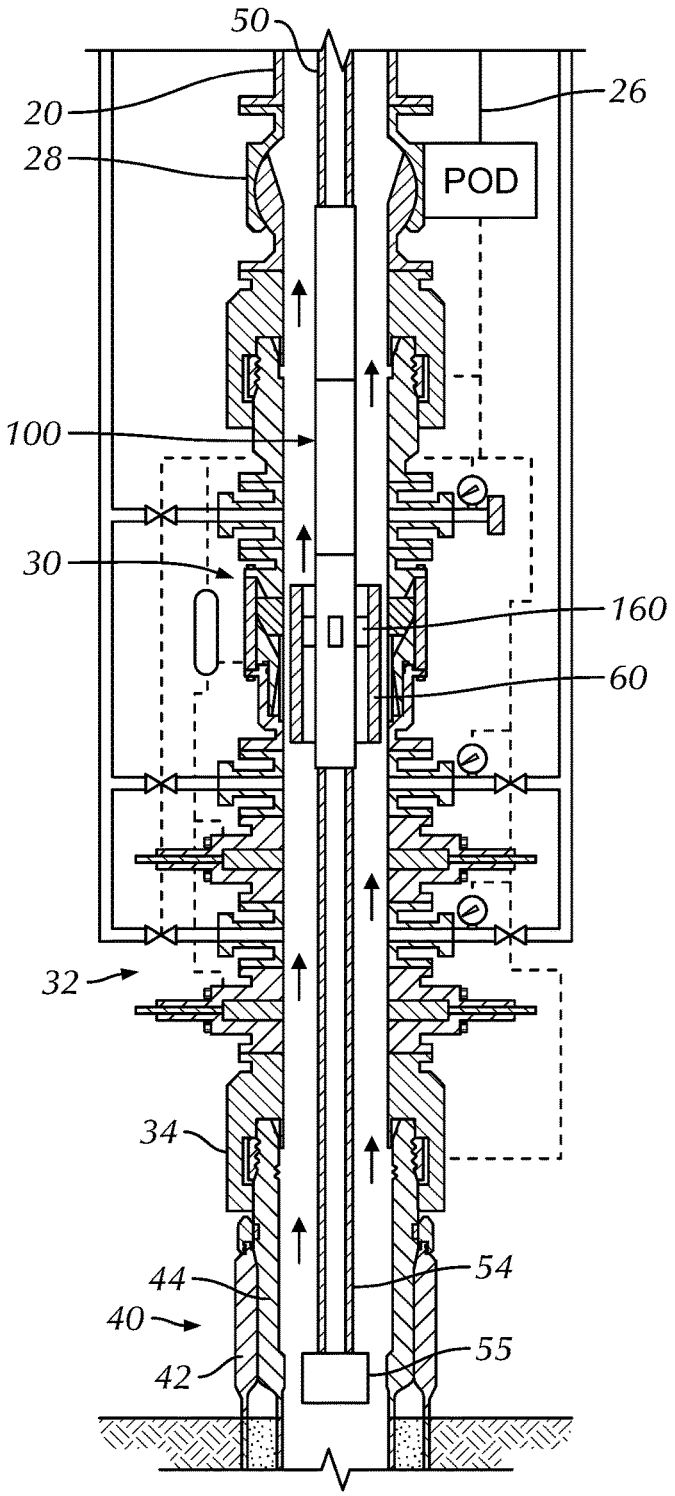

FIGS. 1A-1B illustrate a drilling system 10 deploying a wear bushing or bore protector 60 on a drillstring 50 with a deployment/retrieval apparatus 100 according to the present disclosure. The drilling system 10 may include a drilling unit 12, such as a semisubmersible platform, a mobile offshore unit, a fixed offshore unit, a drill ship, or the like. The drilling unit 10 has a drilling rig 14, fluid handling equipment, mud pumps, and other conventional equipment. For conducting drilling operations, the drilling rig 14 may include a top drive, or a Kelly and rotary table may be used instead of the top drive.

The drilling unit 12 is positioned over a subsea wellhead 40 of a wellbore. A riser 20 can connect the drilling unit 10 to the subsea wellhead 40 with a telescopic joint 22, and the riser 20 may support various flow lines 24 and control lines 26.

As best shown in FIG. 1B, a number of components, such as a riser coupling 28, flow control equipment 30, blow out preventer 32, wellhead adapter 34, and the like may be connected to the subsea wellhead 40. For its part, the subsea wellhead 40 may include a number of conventional components. As shown here, for example, the subsea wellhead 40 has a high-pressure wellhead housing 44 installed in a low-pressure wellhead housing 42. Lockdowns, annulus seals, and other conventional components are typically used. Additional casing and tubing hangers (not shown) may also be present.

In a deployment mode, an upper end of the drillstring 50 may be connected to the top drive, as shown in FIG. 1A. The drillstring 50 may include joints of drillpipe connected together and having a bottom hole assembly 54, as shown in FIG. 1B. In general, the bottom hole assembly 54 can include drill collars, stabilizers, directional drilling equipment (not shown), and a drill bit 55, among other components for conducting drilling operations. To protect the internal surfaces, profiles, landing seats, and the like in the wellhead 40 (and especially in the high pressure wellhead housing 44 or other tubing hanger), the drillstring 50 includes the deployment/retrieval apparatus 100 for first deploying a wear bushing 60 in the wellhead 40 with the drillstring 50 and for then retrieving the wear bushing 60 from the wellhead 40 with the drillstring 50 after drilling operations.

To deploy the wear bushing 60, the deployment/retrieval apparatus 100 is made up on the drillstring 50 with the bottom hole assembly 54 and is run in hole. The apparatus 100 is actuated and supports the wear bushing 60 during run in. Eventually, the wear bushing 60 is lowered into the wellhead 40 and lands on the landing shoulder of the high pressure wellhead housing 44 or other tubing hanger. Shear pins may be used to engage the wear bushing 60 in the wellhead 40.

Figure 1C:
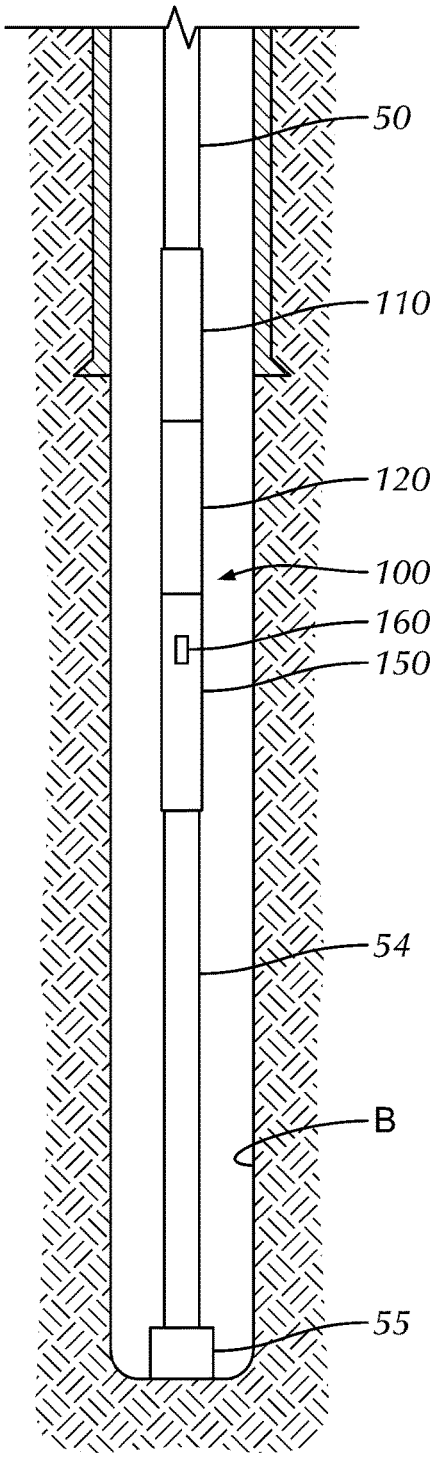
FIG. 1C illustrates portion of the drilling system used during drilling operations after deploying the wear bushing.

With the wear bushing 60 landed, the apparatus 100 is then remotely operated to uncouple or disengage from the wear bushing 60. At this point, the bottom hole assembly 54 and the apparatus 100 can be run in further through the wellhead 40 to conduct drilling or other operations, such as shown in FIG. 1C. During such operations, the apparatus 100 remains deactivated so that elements of the apparatus 100 can avoid wear and damage during operations. When operations are completed, the drillstring 50 is pulled out of hole, and the apparatus 100 is then remotely operated to couple or engage the wear bushing 60 to be lifted out of the wellhead 40 with the drillstring 50.

Arms 160 on the tool 150 can be moved between extended and retracted conditions to engage and disengage the wear bushing 60. The arms 160 can be selectively activated from surface in a number of ways to deploy and retrieve the wear bushing 60 in the subsea wellhead 40 when running in and pulling out the bottom hole assembly 54 through the wellhead 40. Multiple forms of selective activation can be used, including radio-frequency identification activation, pressure command activation, electric signal, etc. These selective activations can be "on demand" and "multiple cycle" activation methods. In general, the apparatus 100 includes a deployment/retrieval tool 150 actuated by an actuation component 120, which is activated by a communication component 110.

Because the apparatus 100 is used for drilling operations, the apparatus 100 is preferably capable of transmitting drilling fluid and pressure through the tool 150, capable of transmitting BHA axial loads through the tool 150, and capable of transmitting BHA torsion loads through the tool 150. In fact, the tool 150 is preferably capable withstand drilling forces and vibration.

Figure 2:
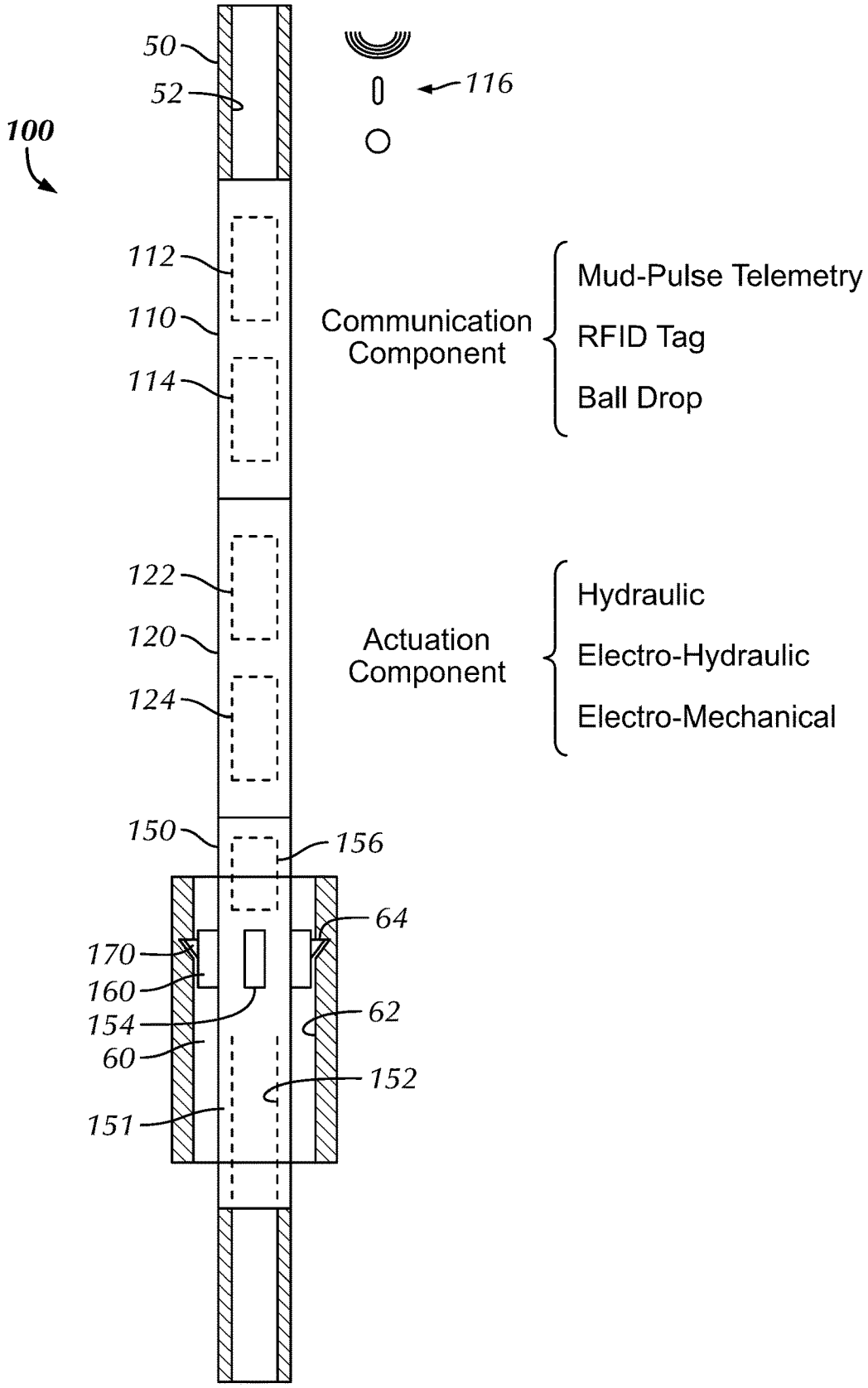
FIG. 2 schematically illustrates an apparatus of the present disclosure for deploying/retrieving a wear bushing on a bottom hole assembly of a drillstring.

With an understanding of how the apparatus 100 can be used for deploying and retrieving a wear bushing 60 in a subsea wellhead 40, discussion turns to FIG. 2, which schematically illustrates an apparatus 100 of the present disclosure in more detail. As noted above, the apparatus 100 is used for deploying/retrieving a wear bushing 60 on a bottom hole assembly of a drillstring 50. The apparatus 100 includes a deployment/retrieval tool 150 having a mandrel 151 and a plurality of arms 160. The tool 150 may also include a plurality of catches or dogs 170 on the arms 160. The wear bushing 60 has a through-bore 62 and is mounted on the tool 150 for deployment and retrieval. The wear bushing 60 can include an internal profile 64 for engagement with the tool 150, or as discussed below, the tool 150 can engage an adapter (not shown) installed in the wear bushing 60 that engages the bushing's internal profile 64.

The tool's mandrel 151 is coupled to the drillstring 50 and defines a flowbore (152) therethrough communicating with the drillstring 50. In this way, the tool 150 can be used for conducting drilling fluid during operations. The tool 150 also defines a plurality pockets 154 defined externally on the mandrel 151. Each of the arms 160 is disposed in one of the externally defined pockets 154, and each of the arms 160 is movable at least laterally in the pocket 154 between a retracted condition (not shown) in the pocket 154 and an extended condition at least partially out of the pocket 154.

To achieve the movement of the arms 160, the tool 150 includes a transfer mechanism 156, which includes one or more components suitable to the type of arms 160 used. In one arrangement, the arms 160 include lever assemblies pivotably movable between the retracted and extended conditions. The transfer mechanism 156 in this case can be a shifter disposed inside the tool 150 and movable (mechanically, hydraulically, etc.) to pivot the lever assemblies of the arms 160. In another arrangement, the arms 160 include pistons movable between the retracted and extended conditions. The transfer mechanism 156 in this case can be a shifter disposed inside the tool 150 and movable (mechanically, hydraulically, etc.) to move the pistons of the arms 160, or the mechanism 156 can include hydraulic features disposed inside the tool 150 to hydraulically move the pistons of the arms 160.

In one arrangement, distal ends of the arms 160 can directly engage the internal profile 64 (or the adapter if used). In another arrangement, the catches 170 (if present) are disposed on each one of the arms 160, and each is biased to extend from the arm 160. Each of the catches 170 on the arms 160 when in the extended condition can support the wear bushing 60 in the uphole direction—e.g., by engaging the internal profile 64 (or adapter). However, each of the catches 170 on the arms 160 when in the extended condition can also retract against the wear bushing 60 or other component in the downhole direction when the tool 150 is passed through.

In addition to the deployment/retrieval tool 150, the apparatus 100 includes an actuation component 120 for actuating the arms 160 to move between the retracted and extended conditions. The actuation component 120 includes an actuator 122 and other elements 124 that depend on the type of actuator 122 and transfer mechanism 156 used. A number of actuators 122 can be used to actuate the movement of the arms 160. In general, the actuator 122 can include a hydraulic actuator operated hydraulically with flow through the drillstring, a hydraulic actuator operated hydraulically with a dedicated hydraulic source, an electromechanical actuator, an electro-hydraulic actuator, or other mechanism. Further details of suitable actuators for use with the disclosed apparatus 100 can be found in U.S. Pat. Pub. 2014/0338976, which is incorporated herein by reference. The additional actuator elements 124 can include a power source, a fluid reservoir, a hydraulic pump, a controller, sensors, and the like, depending on the actuator 122.

The actuator 122 can be locally operated with a controller having sensor, timer, etc. Preferably, the actuator 122 can be remotely operated from the surface. To achieve this, the apparatus 100 can include a communication component 110 for receiving remote instructions to operate the actuator 122 to actuate the arms 160 in accordance with the instructions. The communication component 110 includes an input device 112 and other elements 114 that depend on the type of input used. A number of communication components 110 can be used to receive remote instructions. In general, the communication component 110 can include a mud-pulse telemetry device, a radio-frequency identification receiver, or other device used for surface-to-downhole communication. (Two way communication may be beneficial to indicate proper operation of the tool 150.) The additional communication elements 114 can include a power source, a controller, sensors, antennas, and the like, depending on the input device 112, form of communication used, and communication means 116 (e.g., mud pulse, RFID tag, actuation ball, etc.). Further details of suitable communication components for use with the disclosed apparatus 100 can be found in incorporated U.S. Pat. Pub. 2014/0338976.

As noted above, the deployment/retrieval tool 150 can include arms 160 having pistons movable between the retracted and extended conditions. As shown in the cross-sectional view of FIG. 3, one form of tool 150 for deploying/retrieving a wear bushing 60 in a wellhead 40 includes arms 160 as pistons. As shown, the tool 150 connected to the drillstring 50 supports the wear bushing 60 landed in the high pressure wellhead housing 44 of the wellhead 40. The piston arms 160 in an extended condition can engage directly in the internal profile 64 formed inside the throughbore 62 of the bushing 60. Alternatively, as specifically shown in FIG. 3, the piston arms 160 in the extended condition can engage the internal profile of an intermediate bushing or adapter 200 connected to the bushing's profile 64. (Details of the adapter 200 are discussed later.)

As discussed herein, the tool 150 can be disposed on the drillstring 50 to deploy and retrieve the wear bushing 60 in the subsea wellhead 40. For example, the wear bushing 60 can be used inside the high-pressure wellhead housing 44 installed in the low-pressure wellhead housing 42, and the wear bushing 60 can seat against a casing hanger 46 landed in the high-pressure wellhead housing 44. Although the arms 160 support the wear bushing 60 in the uphole direction, portion of the arms 160 can be configured to engage the wear bushing 60 in the downhole direction. Accordingly, when the wear bushing 60 is landed in the wellhead components 44 and 46, downward force of the tool 150 can be applied to the wear bushing 60 by engagement of the portion of the arms 160. This can help fit the wear bushing 60 in the wellhead components 44 and 46 so that catch pins in slots 63 on the wear bushing 60 can engage in an internal profile of the wellhead housing 44. Additionally, when the wear bushing 60 is retrieved from the wellhead components 44 and 46, for example, upward force of the tool 150 is applied to the wear bushing 60, but engagement of the portion of the arms 160 to the wear bushing 60 in the wellhead components 44 and 46 can help steady the wear bushing 60 as the catch pins in the slots 63 are sheared free.

In general, the piston arms 160 can be moved in one direction with hydraulic communication and can be moved in the other direction with spring bias or with hydraulic communication. Of course, spring bias and hydraulic communication can be used together in the same direction if desired. Preferably, hydraulic communication is used for moving the piston arms 160 in both the retracted and extended conditions.

Figure 5A:
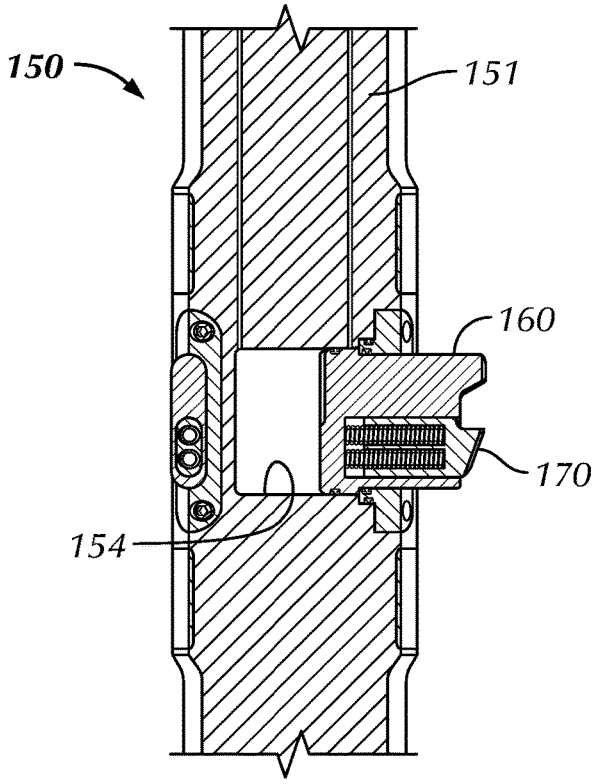
FIGS. 5A-5B illustrate a cross-sectional view and an end-sectional view of the disclosed apparatus in the activated state.
Figure 6:
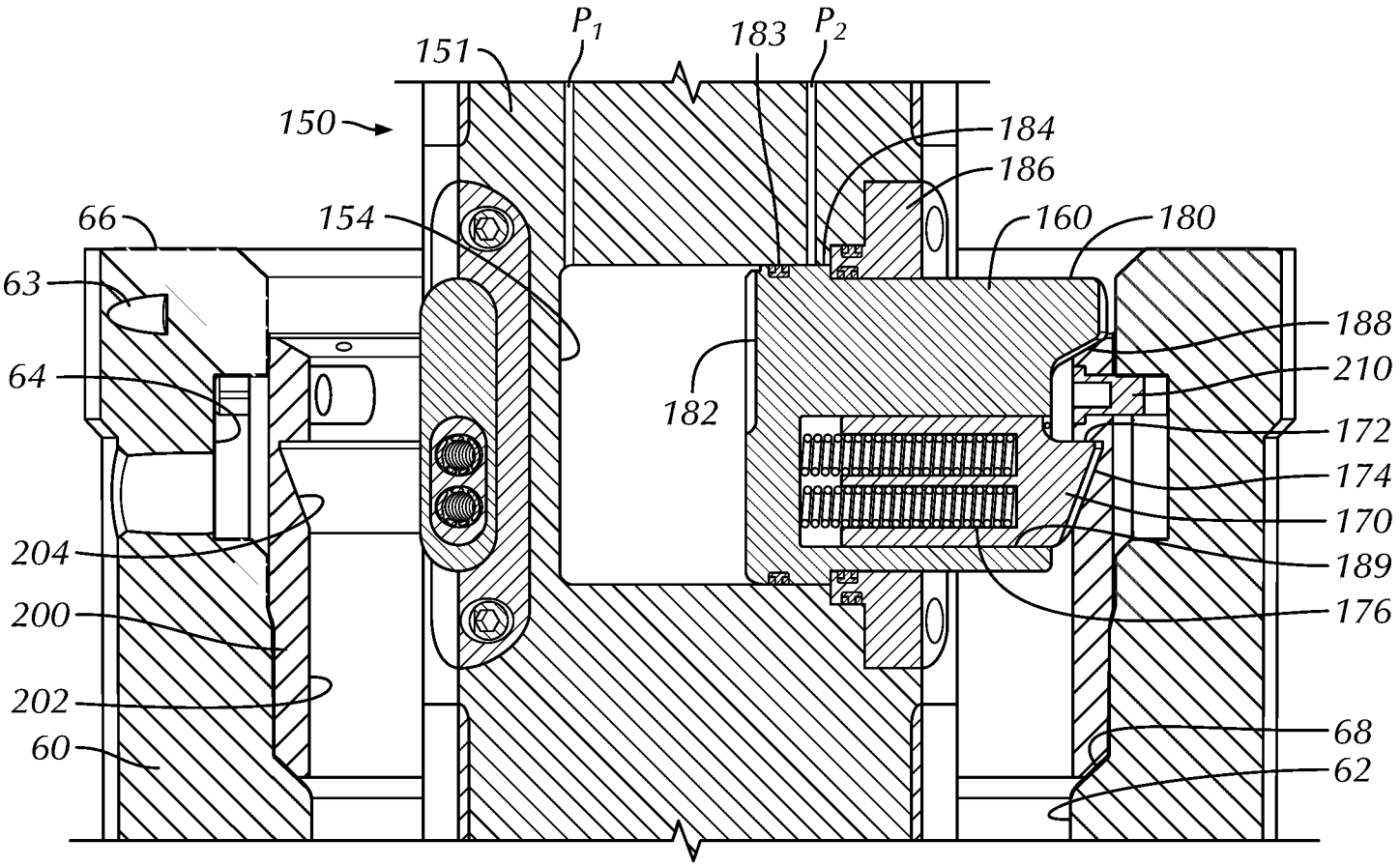
FIG. 6 illustrates a cross-sectional view the disclosed apparatus deploying the wear bushing in the subsea wellhead.

In the particular embodiment shown in FIGS. 5A, 6, etc., the mandrel 151 comprises first and second hydraulic ports $P_1$ and $P_2$ for each piston 180 of the arms 160. Each of the pistons 180 may share common hydraulics via the ports $P_1$ and $P_2$ from the same sources, because all of the pistons 180 may be moved in unison. However, if desired, each piston 180 can have its ports $P_1$ and $P_2$ connected to a dedicated source of hydraulics.

Figure 9A:
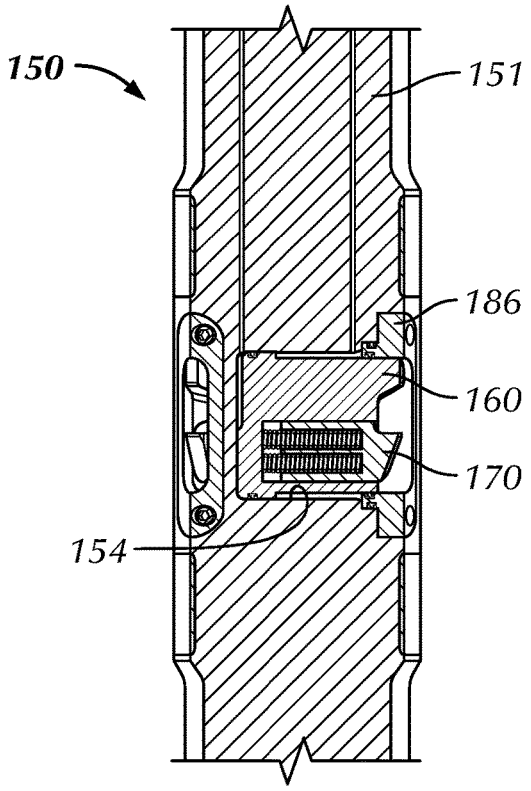
FIGS. 9A-9B illustrate a cross-sectional view and an end-sectional view of the disclosed apparatus in the deactivated state.
Figure 8B:
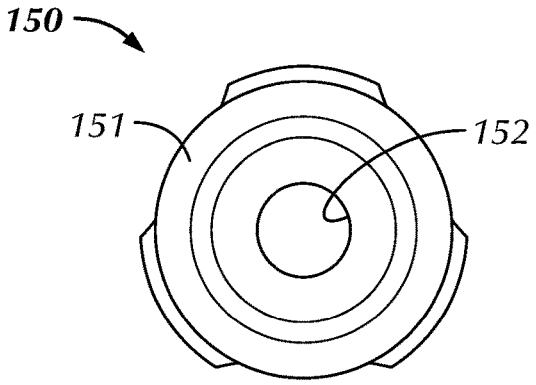
Figure 9B:
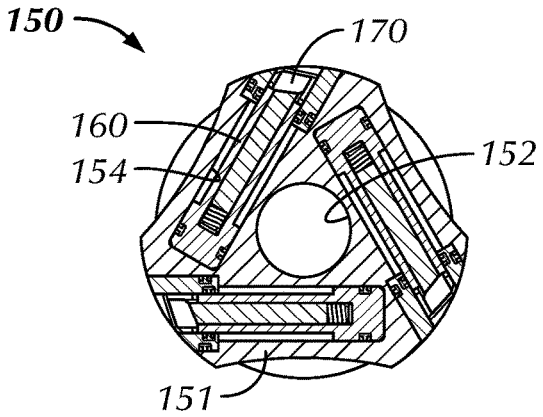

As best shown in FIG. 6, the piston 180 of each of the arms 160 has first and second opposing piston surfaces 182, 184 sealed in one of the mandrel's pocket 154. Each of the pistons 180 is movable from the retracted condition (FIG. 9A) to the extended condition (FIGS. 5A & 6) with first hydraulic communication from the first hydraulic port $P_1$ against the first piston surface 182, while the second port $P_2$ vents the chamber. Each of the pistons 180 is thereby movable in the opposite manner with second hydraulic communication from the second hydraulic port $P_2$ against the second piston surface 184, while the first port $P_1$ vents the other chamber. Seals 183 on the piston 180 seal with the pocket 154 to form the two piston chambers. A retainer 186 affixed to the external surface of the pocket 154 also seals with the pocket 154 and is used for assembly to hold the piston 180 in the pocket 154.

As best shown in FIG. 6, each of the catches 170 includes a first surface or contact shoulder 172 facing in the uphole direction and includes a second surface or incline 174 facing in the downhole direction. The contact shoulder 172 supports against the internal profile 64 of the wear bushing 60 (or against an internal profile 204 of the adapter 200 if used) in the uphole direction with the catch 170 biased to extend. The catch 170 is retractable against the bias with the incline 174 when passed against the wear bushing 60 (or against the adapter 200 if used) in the downhole direction.

For further support, each of the pistons 180 can have a second downhole-facing surface or incline 188 supportable against an edge of the wear bushing 60, adapter 200 (if used), or other surface. As noted above, for example, portion of the arms 160 can be configured to engage the wear bushing 60. When the wear bushing 60 is landed in and removed from the wellhead components 44 and 46, the portion of the arms 160 can help support the wear bushing 60. As shown in FIG. 6, for example, the shoulder 188 on the distal end of the pistons 180 can engage a shoulder inside the wear bushing 60 (i.e., either directly against an upper shoulder 66 of the wear bushing 60 or directly against an upper shoulder of the adapter 200 if used) for this purpose. As shown in FIG. 6, the second downhole-facing surface or incline 188 of the pistons 180 are supportable against an edge of the adapter 200. This provides upward support of the wear bushing 60 during deployment and retrieval.

As noted herein, the tool 150 can directly grip or engage the internal profile 64 in the wear bushing 60. The geometry of this gripping profile 64 can vary among different wellhead systems and bushings 60. Sometimes, a larger wear bushing 60 may be run in the wellhead 40. Using an internal bushing or adapter 200 disposed in the through-bore 62 of the wear bushing 60 can help the tool 150 for use with different sized wear bushings 60 and for use with different gripping profiles on the wear bushings 60. In this way, the extension of the arms 160 in the extended condition need not reach fully to the inner diameter of the wear bushing 60.

Figure 7A:
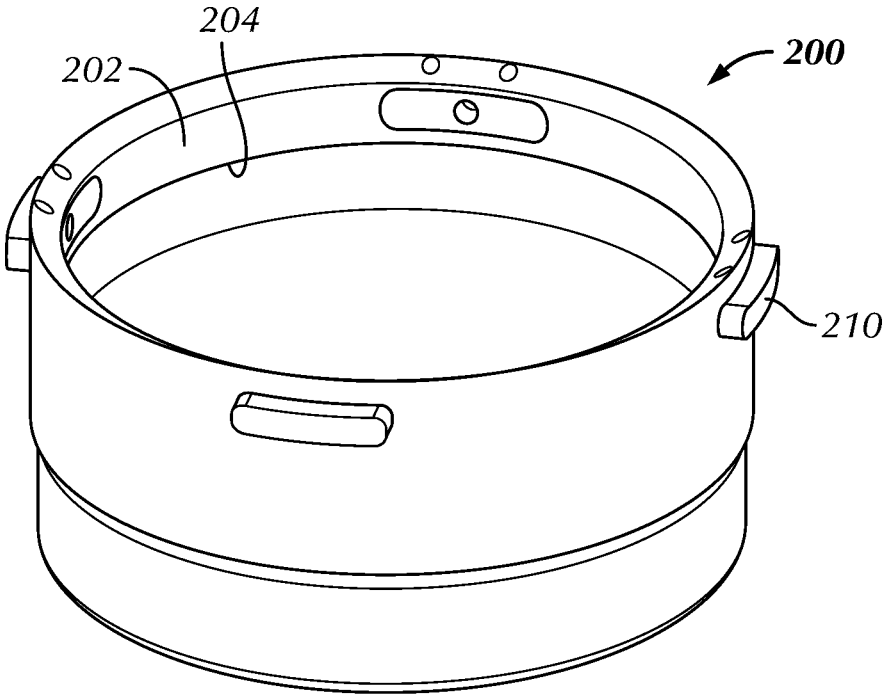
FIGS. 7A-7B illustrate an elevational view and a cross-sectional view of an adapter for use with a wear bushing.
Figure 7B:
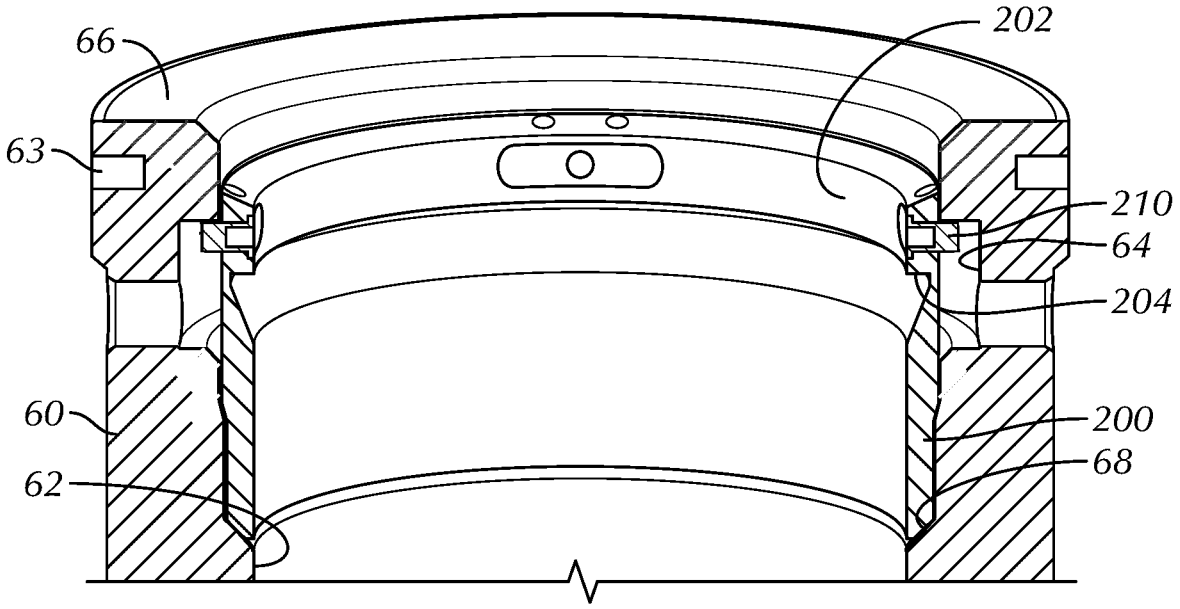
Figure 8A:
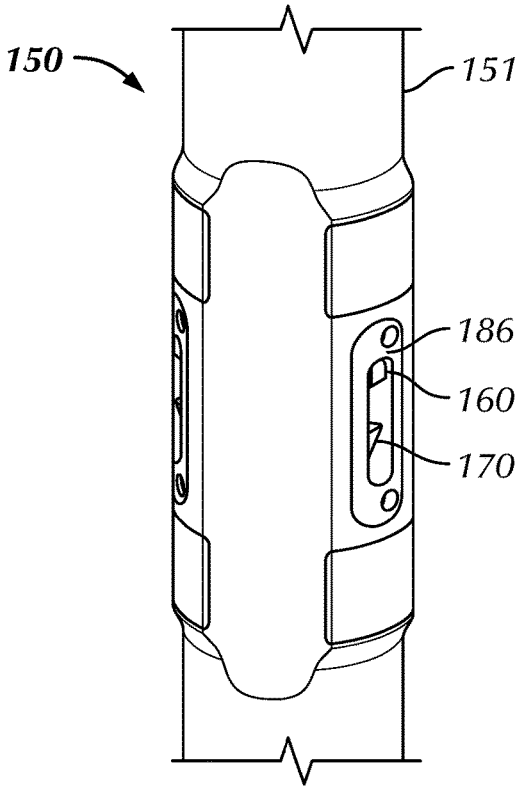
FIGS. 8A-8B illustrate a perspective view and an end view of the disclosed apparatus in a deactivated state.

As shown in FIGS. 7A-7B, the adapter 200 has an internal profile 204 defined inside the inner passage 202 of the adapter 200. The internal profile 204 has a downhole-facing shoulder or lip directly engageable with the shoulder of the catches 170. The adapter 200 also has a plurality of external supports 210 engageable with the internal profile 64 of the wear bushing 60.

The adaptor 200 can be attached inside the wear bushing 60 at surface. Because the adapter 200 has its own internal gripping profile 204 in the inner dimension, the profile 204 can be particularly designed to mate directly with the arms 160 of the running/retrieval tool 150. By using the adapter 200, the same running/retrieval tool 150 can be utilized for different wear bushings 60 for several wellhead systems.

Another advantage of the adapter 200 is that its gripping profile 204 is radially closer to the axis of the wellbore than the original profile 64 in the wear bushing 60. The arms 160 and the catches 170 on the running/retrieval tool 150 do not have to extend as far from the axis in order to grip the sleeve's profile 204. This can help reduce the stresses seen by the tool 150 when running in the wear bushing 60 and pulling the wear bushing 60 from the wellhead 40.

Preferably and as shown in FIGS. 8A-8B and 9A-9B, the piston arms 160 in the retracted condition in the pocket 154 recess inside an external surface of the mandrel 151 so that the piston arms 160 are not subject to wear when the bottom hole assembly (54) on the drillstring (50) is used further downhole during operations. Moreover, the catches 170 on the piston arms 160 in the retracted condition in the pocket 154 each preferably recesses inside the external surface of the mandrel 151 as well.

Figure 4B:
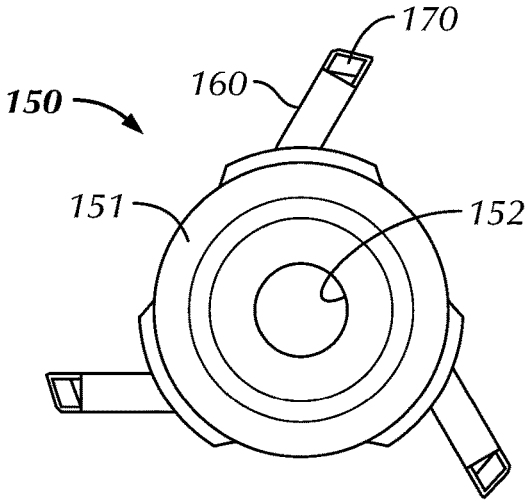
Figure 5B:
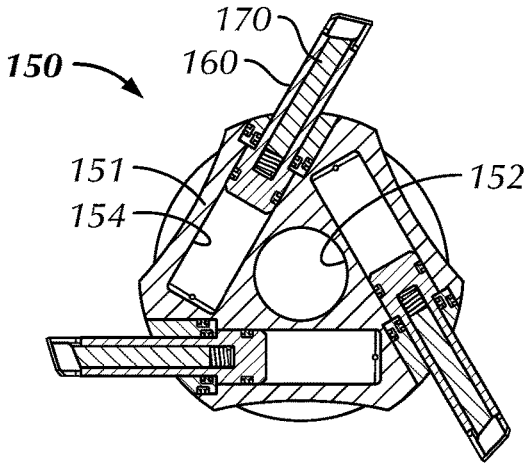

As shown in FIGS. 4B, 5B, etc., the piston arms 160 can include at least three piston arms 160 disposed equally circumferentially about the mandrel 151. At least two piston arms 160 could be used, but more than two are preferably used for proper support of the wear bushing (60). As also shown in FIG. 4B, 5B, etc., each of the piston arms 160 can be movable tangentially relative the exterior of the mandrel 151. If space on the mandrel 151 is available, each of the piston arms 160 can be movable radially outward from the exterior of the mandrel 151—i.e., perpendicular to the outer circumference of the mandrel 151.

With an understanding of the tool 150 and other components, its use in deploying and retrieving a wear bushing can proceed as follows. To use the wear bushing 60 in the subsea wellhead 40 with the drillstring 50, the tool 150 can be used to deploy the wear bushing 60 in the wellhead 40 with the drillstring 50 when running in the bottom hole assembly 54 to perform an operation. Then, the tool 150 can be used to retrieve the wear bushing 60 from the wellhead 40 with the drillstring 50 when pulling out the bottom hole assembly 54 after the operation.

Figure 3:
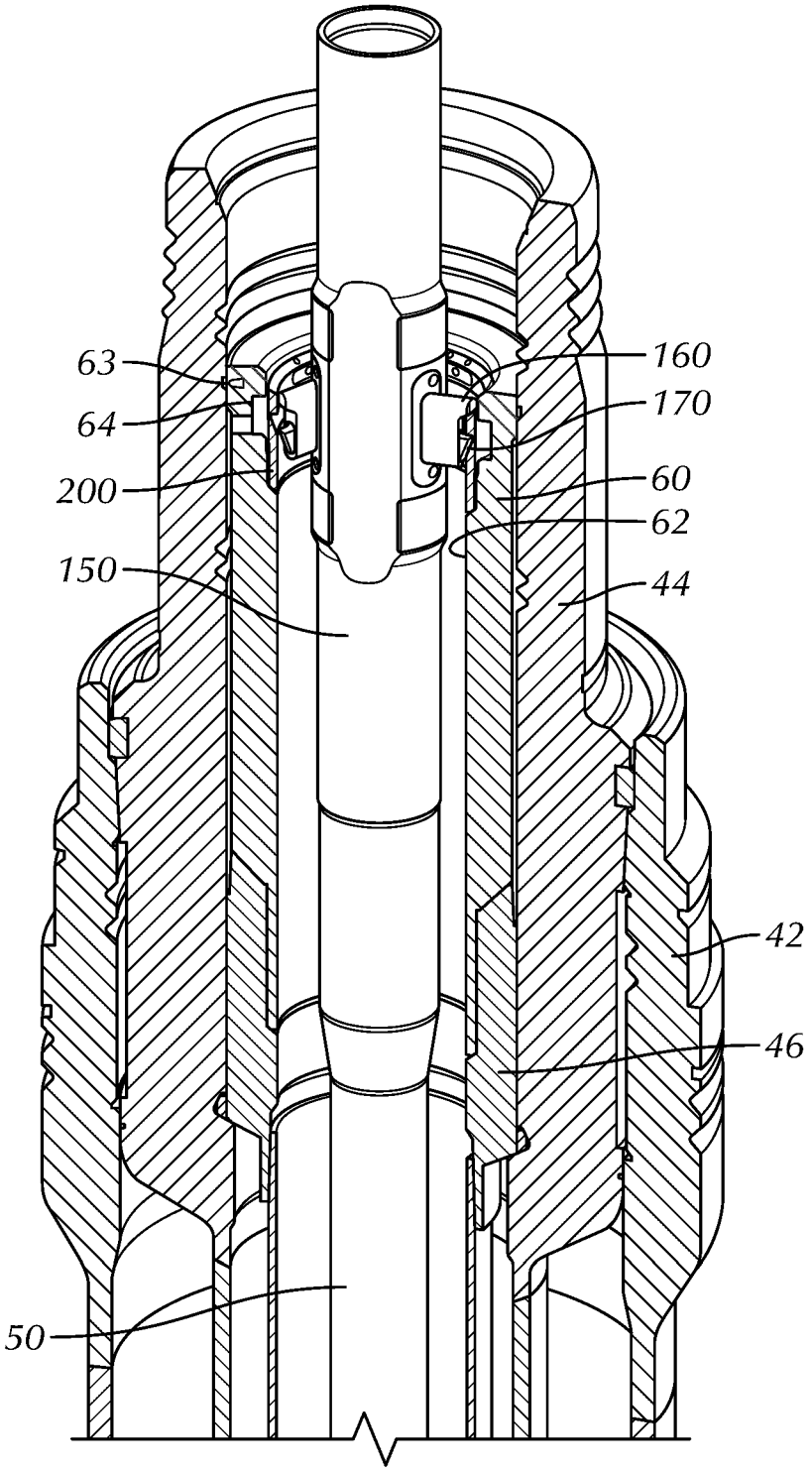
FIG. 3 illustrates a cross-sectional view of one form of apparatus for deploying a wear bushing in a subsea wellhead.
Figure 4A:
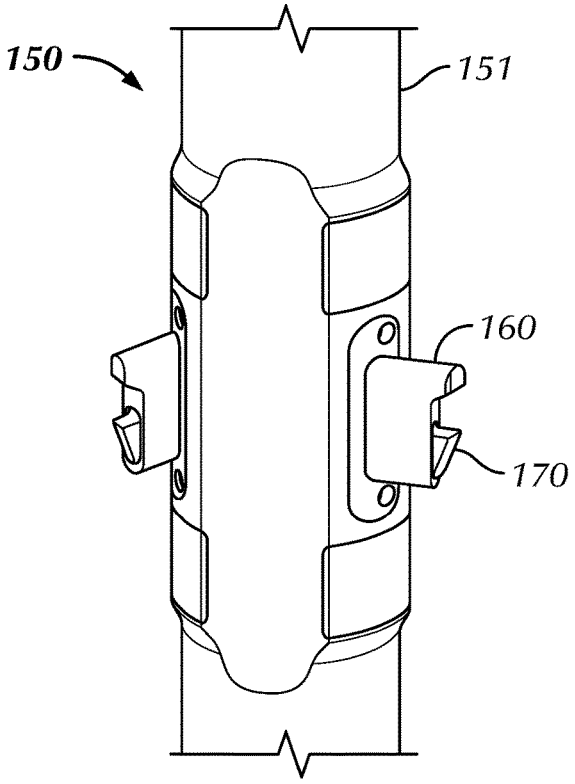
FIGS. 4A-4B illustrate a perspective view and an end view of the disclosed apparatus in an activated state.

To deploy the wear bushing 60, the tool 150 is installed on the drillstring 50 by threaded connections as common in the art. The wear bushing 60 is supported on the tool 150 with the arms 160 in the extended condition engaging either the internal profile 64 of the wear bushing 60 or the internal profile 204 of the adapter 200, as depicted here. Using conventional running procedures on the rig, the wear bushing 60 is run in with the tool 150 on the drillstring 50 while the extend arms 160 and catches 170 support the wear bushing 60. Eventually, the wear bushing 60 is landed in the wellhead 40. As is typical, a landing shoulder on the wear bushing 60 lands on a landing shoulder in the wellhead 40, such as on a tubing hanger 46 of the wellhead 40 as shown in FIG. 3.

Shoulders 188 on the pistons 180 are configured to engage the adapter 200 and/or the wear bushing 60. When the wear bushing 60 is landed in the wellhead components 44 and 46 as shown in FIG. 6, for example, downward force of the tool 150 can be applied to the wear bushing 60 by engagement of the shoulders 188. This can help fit the bushing 60 in the wellhead components 44 and 46 so that the catch pins (not shown) in pockets 63 on the wear bushing 60 engage in the internal profile of the high-pressure wellhead housing 44 to hold the wear bushing 60 in the wellhead 40. These pins can be biased by springs and can be sheared with an upward force.

With the wear bushing 60 landed, the pistons 180 are actuated to a retracted condition on the tool 150 by actuating the apparatus 100 with remote communication. For example, actuating the apparatus 100 can involve: detecting a radio frequency identification tag with the apparatus 100; detecting a mud pulse with a mud pulse telemetry component of the apparatus 100; wedging the pistons 180 laterally by moving a shifter longitudinally in the apparatus 100; hydraulically moving the pistons 180 into the pockets 154; or performing some form of mechanical, hydraulic, and electric operation.

At this point, the pistons 180 and catches 170 are retracted into the pockets 154 as shown in FIGS. 8A through 9B, and the drillstring 50 and the tool 150 can be run in further through the subsea wellhead 40 to perform the desired operations. Meanwhile, the pistons 180 remain retracted in the mandrel 151 so as to avoid issues with damage and wear.

At any time during operations, the tool 100 allows for selective retrieval of the wear bushing 60. For example, operators can activate the tool 100 remotely to retrieve the wear bushing 60 when pulling the drillstring 50 out of the hole, such as when the bushing 60 is no longer needed. Of course, when pulling the bottom hole assembly 54 out of the hole, the operators instead may not activate the tool 150 in order to leave the wear bushing 60 in place. For example, a component of the bottom hole assembly 54 can be changed or fixed at surface, and the bottom hole assembly 54 can then be run in hole again without the need to retrieve and redeploy the wear bushing 60. Being able to leave the bushing 60 in place when tripping out of the hole can be beneficial when the bottom hole assembly 54 needs to be pulled to replace a component, such as a worn out bit, or to make some other modification.

Figure 10E:
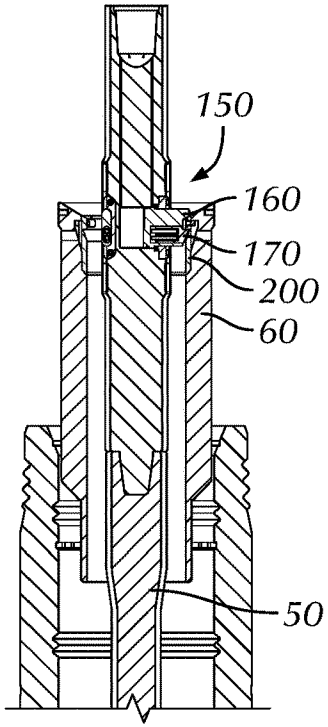
FIGS. 10A-10E illustrate cross-sectional views of the disclosed apparatus retrieving the wear bushing from the subsea wellhead.
Figure 10D:
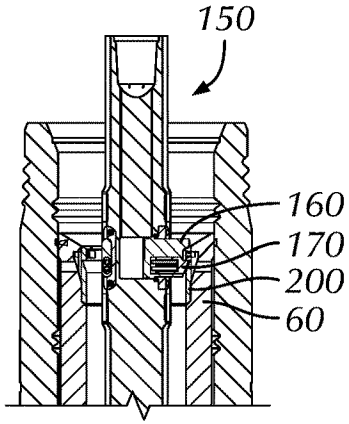
Figure 10C:
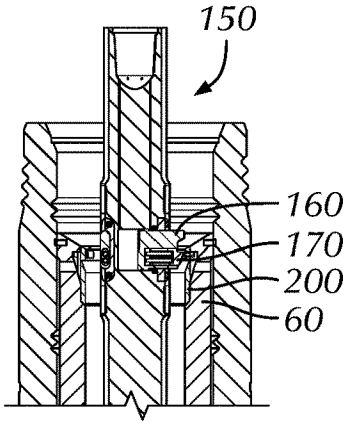
Figure 10B:
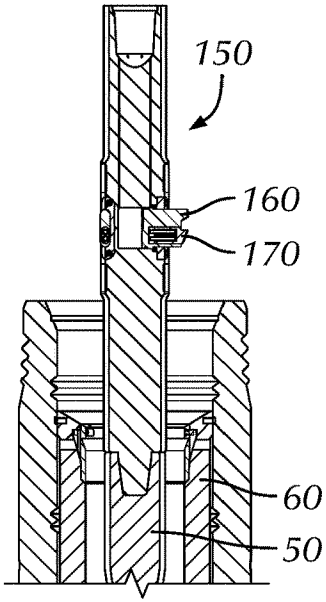
Figure 10A:
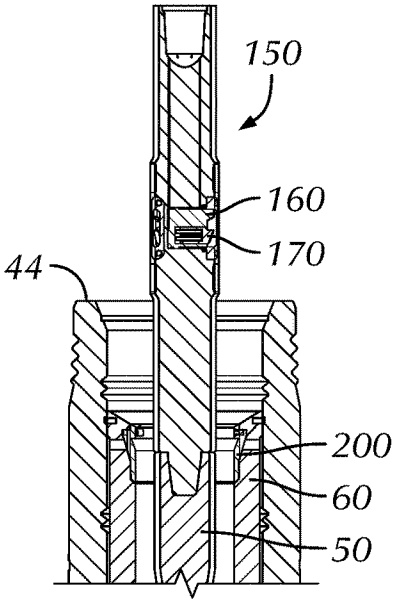

Eventually, the wear bushing 60 is to be retrieved from the wellhead 40 with the apparatus 100 on the drillstring 50. Turning to FIGS. 10A-10E, the disclosed apparatus 100 is shown during steps of retrieving the wear bushing 60 from the subsea wellhead 40. To retrieve the wear bushing 60, the tool 150 with the piston arms 160 retracted is pulled out on the drillstring 50 to a point uphole of the wellhead 40, as shown in FIG. 10A. The piston arms 160 are then extended from the retracted condition to the extended condition on the tool 150 by actuating the apparatus 100 with the remote communication, as shown in FIG. 10B.

The tool 150 is then run into the wear bushing 60 with the drillstring 50. As shown in FIGS. 10C-10D, the catches 170 on the piston arms 160 pass the internal lip 204 of the adapter 200 by being biased inward while on the extended piston arms 160. In particular, the spring loaded catches 170 retract as the inclines (174) contact the restriction above the adapter's profile 204. The spring loaded catches 170 snap into internal gripping profile 204 of the adapter 200, and the downward facing shoulder 188 on the piston arm's distal end can contact the upward facing edge on the adapter 200.

Pulling up on the drillstring 50 can then engage contact shoulders (172) of the catches 170 against the downward facing shoulder in the adapter's profile 204. The wear bushing 60 is then pulled out from the wellhead 40 with the tool 150 by supporting the wear bushing 60 on the catches 170 of the extended piston arms 160. As noted above, the wear bushing 50 may be initially held in the wellhead 40 with retaining pins. In this case, the drillstring 50 may be pulled up with an amount of over-pull (e.g., about 50-klb.) to shear the retaining pins to free the bushing 60 for retrieval to surface. Because the wear bushing 60 may move or jostle during retrieval, the distal ends of the piston arms 160 can be sufficiently supported by the upper shoulder (188) and catches (170) in both uphole and downhole directions against the wear bushing 60 or the adapter 200.

While the apparatus 100 is activated, axial force from the drillstring 50 can be transferred to the internal profile 64 of the wear bushing 60 in order to pull the bushing 60 upward. Should excessive over-pull be seen when attempting to remove the wear bushing 60, the arms 160 can be retracted and the tool 150 and drillstring 50 removed from the wellbore. A separate trip with another tool can then be made to retrieve the wear bushing 60.

As noted above, the deployment/retrieval tool 150 can include arms 160 having pistons 180 without catches. As shown in the cross-sectional view of FIG. 11, another form of tool 150 for deploying/retrieving a wear bushing 60 in a subsea wellhead 40 includes arms 160 having pistons without catches. As shown, the tool 150 connected to the drillstring 50 supports the wear bushing 60 landed in the wellhead components 44 and 46 of the wellhead 40. The piston arms 160 in an extended condition can engage the internal profile 64 formed inside the through-bore 62 of the bushing 60. Alternatively, as specifically shown in FIG. 11, the piston arms 160 in the extended condition can engage inside an adapter 200 connected to the bushing's profile 64. (Details of the adapter 200 are discussed later.)

As discussed herein, the tool 150 can be disposed on the drillstring 50 to deploy and retrieve the wear bushing 60 in the subsea wellhead 40. For example, the wear bushing 60 can be used inside a high-pressure wellhead housing 44 installed in a low-pressure wellhead housing 42, and the wear bushing 60 can seat against a casing hanger 46 landing in the housing 44. Although the arms 160 support the wear bushing 60 in the uphole direction, portion of the arms 160 can be configured to engage the wear bushing 60 in the downhole direction. Accordingly, when the wear bushing 60 is landed in the wellhead components 44 and 46, downward force of the tool 150 can be applied to the wear bushing 60 by engagement of the portion of the arms 160. This can help fit the wear bushing 60 in the wellhead components 44 and 46 so that catch pins in slots 63 on the wear bushing 60 can engage in an internal profile of the housing 44. Additionally, when the wear bushing 60 is retrieved from the wellhead components 44 and 46, for example, upward force of the tool 150 is applied to the wear bushing 60, but engagement of the portion of the arms 160 to the wear bushing 60 in the wellhead components 44 and 46 can help steady the wear bushing 60 as the catch pins in the slots 63 are sheared free.

In general, the piston arms 160 can be moved in one direction with hydraulic communication and can be moved in the other direction with spring bias or with hydraulic communication. Of course, spring bias and hydraulic communication can be used together in the same direction if desired. Preferably, hydraulic communication is used for moving the piston arms 160 in both the retracted and extended conditions.

Figure 13A:
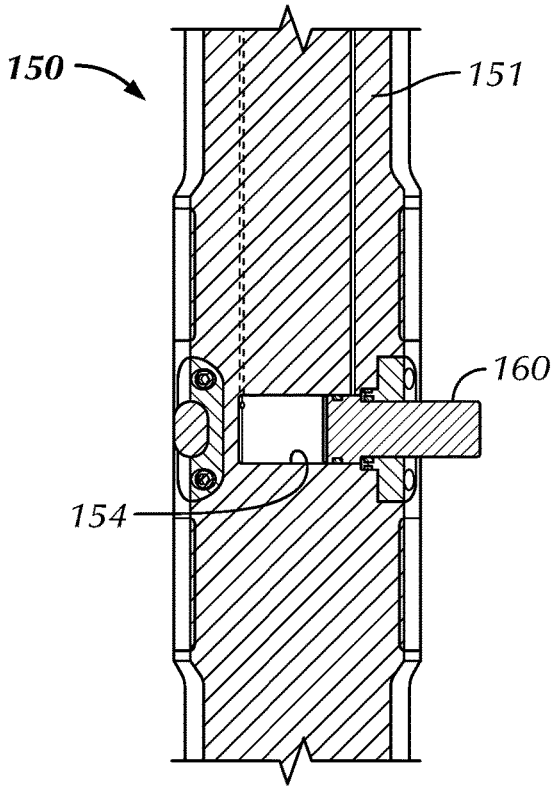
FIGS. 13A-13B illustrate a cross-sectional view and an end-sectional view of the disclosed apparatus in the activated state.
Figure 14:
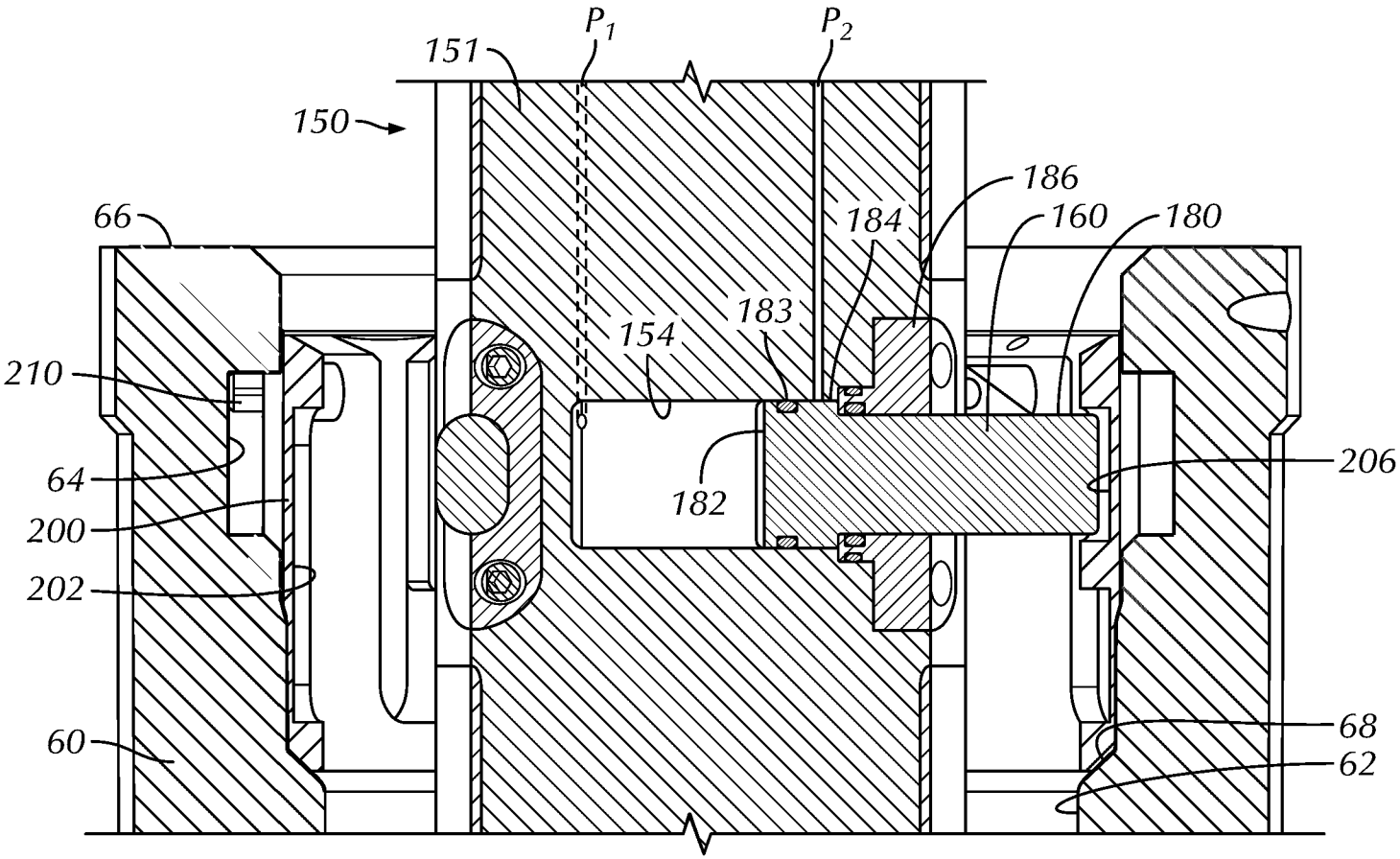
FIG. 14 illustrates a cross-sectional view the disclosed apparatus deploying the wear bushing in the subsea wellhead.

In the particular embodiment shown in FIGS. 13A, 14, etc., the mandrel 151 comprises first and second hydraulic ports P1 and P2 for each of the pistons 180 of the arms 160. Each of the pistons 180 may share common hydraulics via the ports P1 and P2 from the same sources, because all of the pistons 180 may be moved in unison. However, if desired, each piston 180 can have its ports P1 and P2 connected to a dedicated source of hydraulics.

Figure 17A:
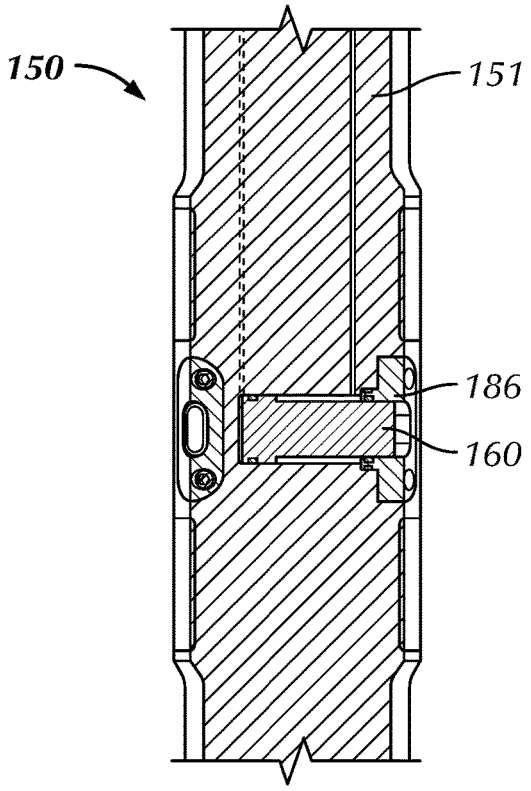
FIGS. 17A-17B illustrate a cross-sectional view and an end-sectional view of the disclosed apparatus in the deactivated state.
Figure 16B:
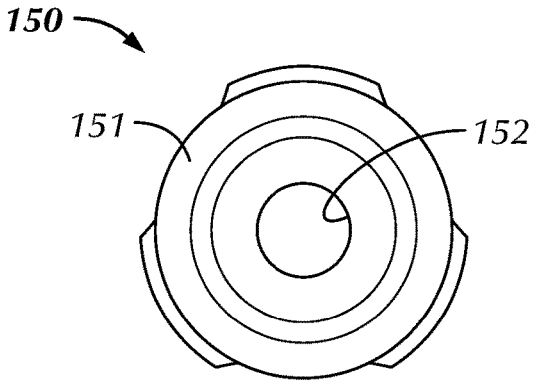
Figure 17B:
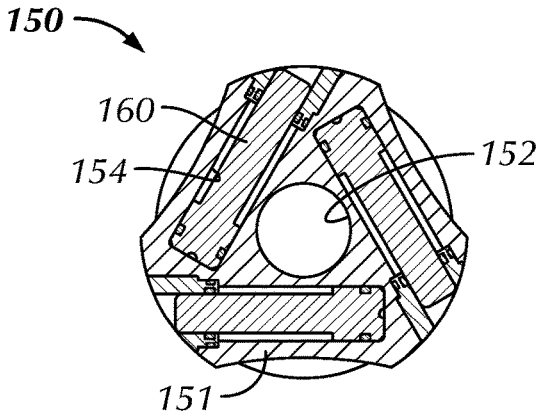

As best shown in FIG. 14, the piston 180 of each of the arms 160 has first and second opposing piston surfaces 182, 184 sealed in the pocket 154. Each of the pistons 180 is movable from the retracted condition (FIG. 17A) to the extended condition (FIGS. 13A & 14) with first hydraulic communication from the first hydraulic port $P_1$ against the first piston surface 182, while the second port $P_2$ vents the chamber. Each of the pistons 180 is thereby movable in the opposite manner with second hydraulic communication from the second hydraulic port $P_2$ against the second piston surface 184, while the first port $P_1$ vents the other chamber. Seals 183 on the piston 180 seal with the pocket 154 to form the two piston chambers. A retainer 186 affixed to the external surface of the pocket 154 also seals with the pocket 154 and is used for assembly to hold the piston 180 in the pocket 154.

In contrast to the previous arrangement, distal ends of the pistons 180 do not include catches. All the same, the distal ends of the pistons 180 can engage in internal profiles to support the wear bushing 60 at least in the uphole direction. For instance, the distal ends can engage in internal profile(s)

of the wear bushing 60 (if available) or can engaging in internal profile(s) of the adapter 200 (if used).

As noted herein, the tool 150 can directly grip or engage the internal profile 64 in the wear bushing 60. The geometry of this gripping profile 64 can vary among different wellhead systems and bushings 60. Sometimes, a larger wear bushing 60 may be run in the wellhead 40. Using an internal bushing or adapter 200 disposed in the through-bore 62 of the wear bushing 60 can help the tool 150 for use with different sized wear bushings 60 and for use with different gripping profiles on the wear bushings 60. In this way, the extension of the arms 160 in the extended condition need not reach fully to the inner diameter of the wear bushing 60.

Figure 15A:
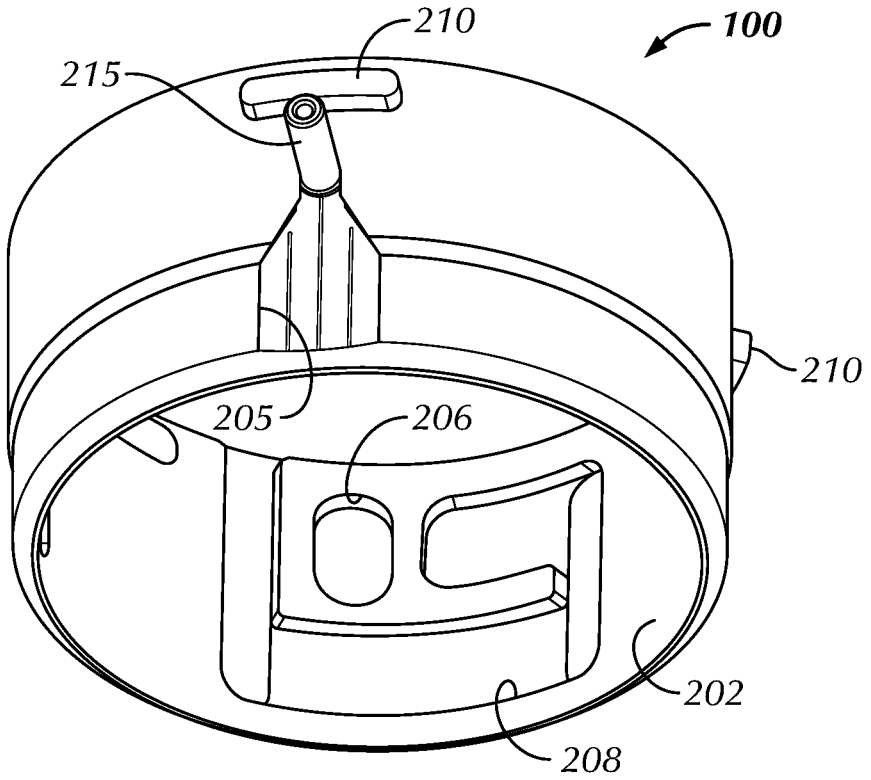
FIGS. 15A-15B illustrate an elevational view and a cross-sectional view of an adapter for use with a wear bushing.
Figure 15B:
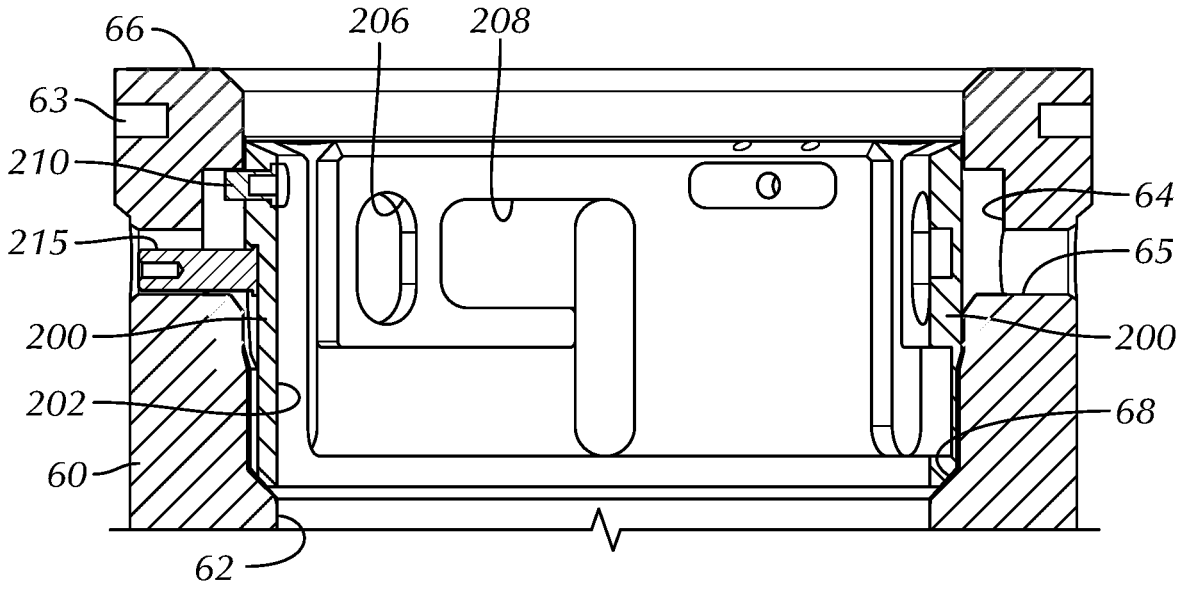
Figure 16A:
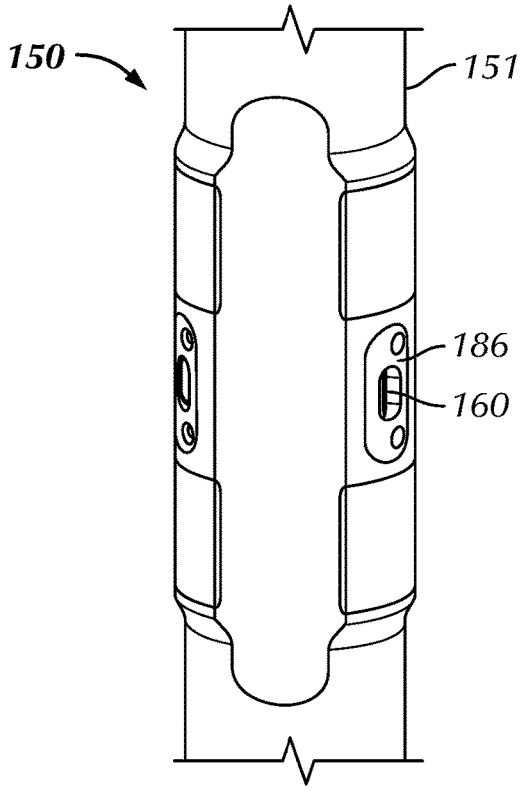
FIGS. 16A-16B illustrate a perspective view and an end view of the disclosed apparatus in a deactivated state.

As best shown in FIGS. 15A-15B, the adapter 200 has internal profiles 206, 208 defined inside the inner passage 202 of the adapter 200. The internal profiles 206, 208 can include one or more of a recessed relief 206 and a J-latch profile 208. The recessed relief 206 can be used for deployment, as it allows the pistons 180 to engage in the uphole direction to support the wear bushing 60, but also allows the pistons 180 to engage in the downhole direction to land the wear bushing 60 in the hangers. The J-latch profile 208 can be used for retrieval, as it allows for the pistons 180 to be located in the adapter 200 and engage in the uphole direction to support the wear bushing 60. (As will be appreciated, if the adapter 200 is not used, comparable profiles to the adapter's profile 206, 208 can be defined in the wear bushing 60 if desired.)

As best shown in FIGS. 15A-15B, supports can hold the adapter 200 in the wear bushing 60. The supports can include pins 210 disposed in slots of the adapter 200 and engaged against the wear bushing 60, such as the downward facing shoulder of the bushing's profile 64. The supports can also include anti-rotation pins 215 engaged in external mule slots 205 on the adapter 200 and disposed in existing side apertures 65 in the wear bushing 60.

The adaptor 200 can be attached inside the wear bushing 60 at surface. The adapter 200 has its own internal gripping profiles 206, 208 in the inner dimension, which can be particularly designed to mate directly with the running/retrieval tool 150. By using the adapter 200, the same running/retrieval tool 150 can be utilized for different wear bushings 60 for several wellhead systems.

Another advantage of the adapter 200 is that its gripping profiles 206, 208 are radially closer to the axis of the wellbore than the original profile 64 in the wear bushing 60. The arms 160 on the running/retrieval tool 150 do not have to extend as far from the axis in order to grip the sleeve's profiles 206, 208. This can help reduce the stresses seen by the tool 150 when running in the wear bushing 60 and pulling the wear bushing 60 from the wellhead 40.

Preferably and as shown in FIGS. 16A-16B and 17A-17B, the piston arms 160 in the retracted condition in the pocket 154 recess inside an external surface of the mandrel 151 so that the piston arms 160 are not subject to wear when the bottom hole assembly (54) on the drillstring (50) is used further downhole during operations.

Figure 12B:
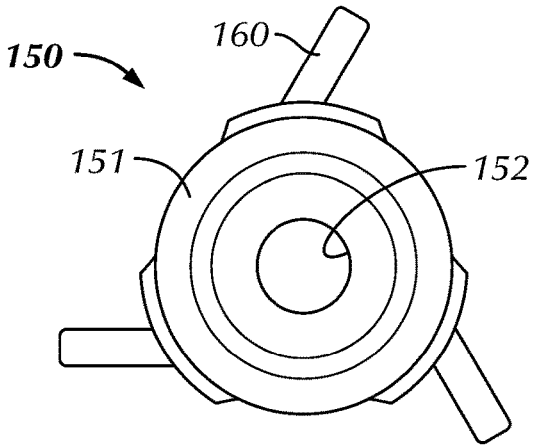
Figure 13B:
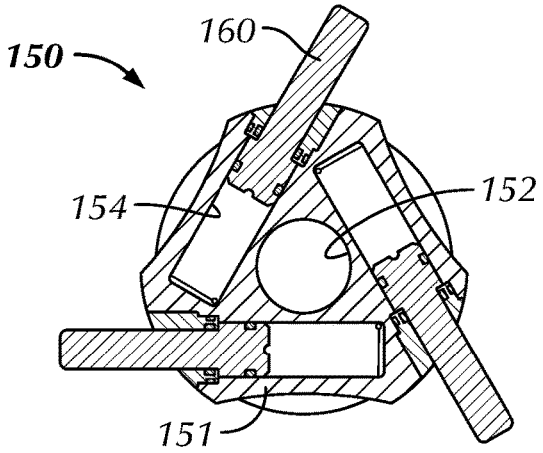

As shown in FIGS. 12B, 13B, etc., the piston arms 160 can include at least three piston arms 160 disposed equally circumferentially about the mandrel 151. At least two pistons 180 could be used, but more than two are preferably used for proper support of the wear bushing (60). As also shown in FIGS. 12B & 13B, each of the pistons 180 can be movable tangentially relative the exterior of the mandrel 151. If space on the mandrel 151 is available, each of the piston arms 160 can be movable radially outward from the exterior of the mandrel 151—i.e., perpendicular to the outer circumference of the mandrel 151.

With an understanding of the tool 150 and other components, its use in deploying and retrieving a wear bushing can proceed as follows. To use the wear bushing 60 in the subsea wellhead 40 with the drillstring 50, the tool 150 can be used to deploy the wear bushing 60 in the wellhead 40 with the drillstring 50 when running in the bottom hole assembly 54 to perform an operation. Then, the tool 150 can be used to retrieve the wear bushing 60 from the wellhead 40 with the drillstring 50 when pulling out the bottom hole assembly 54 after the operation.

Figure 11:
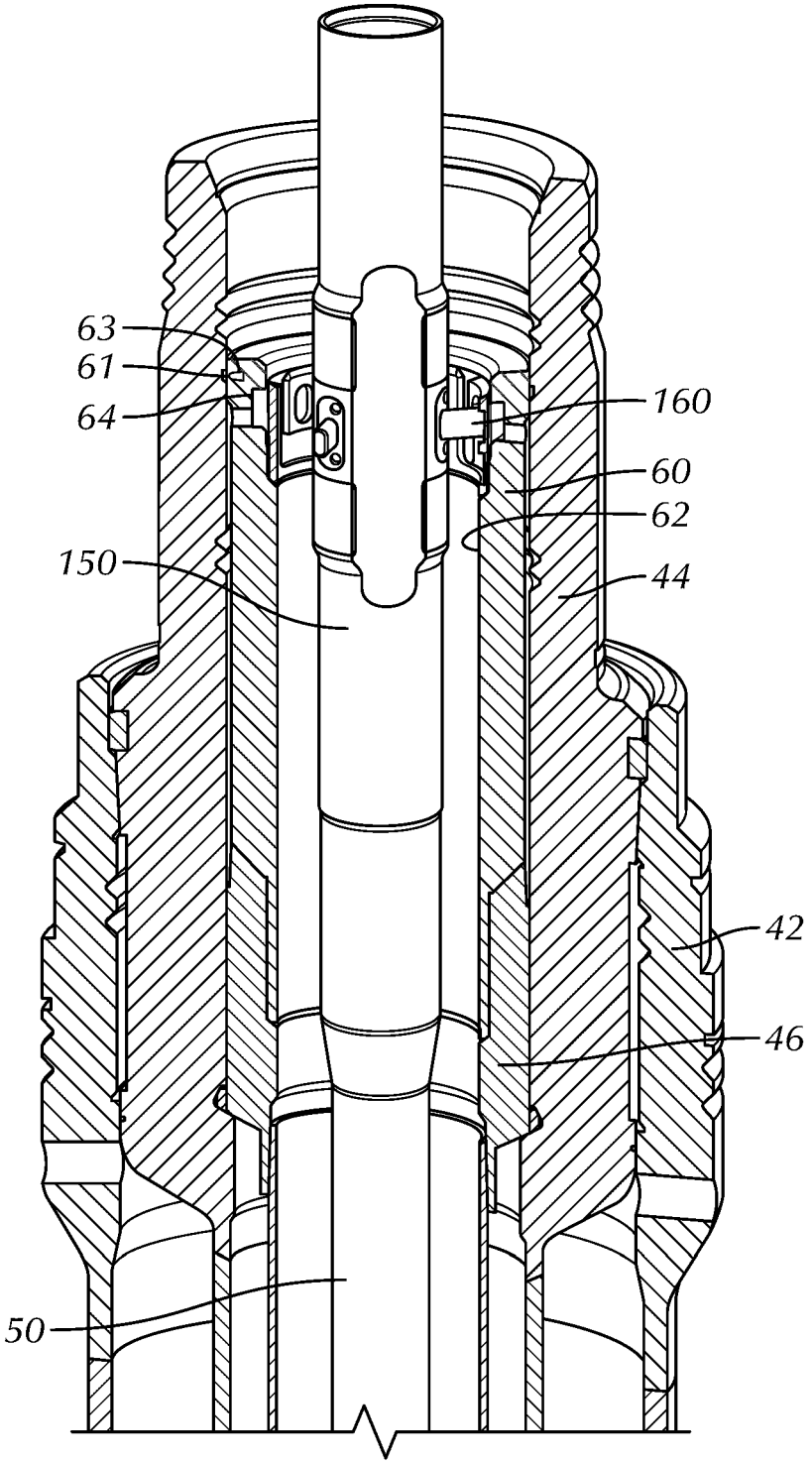
FIG. 11 illustrates a cross-sectional view of another form of apparatus for deploying a wear bushing in a subsea wellhead.
Figure 12A:
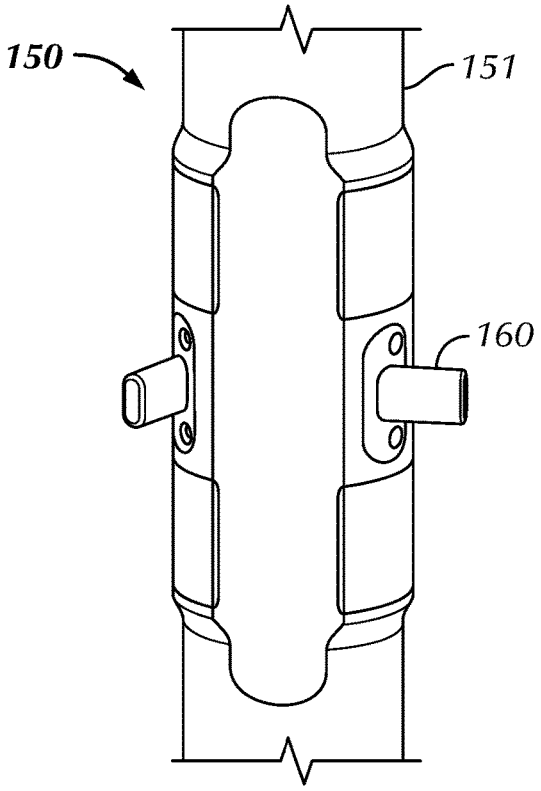
FIGS. 12A-12B illustrate a perspective view and an end view of the disclosed apparatus in an activated state.

To deploy the wear bushing 60, the tool 150 is installed on the drillstring 50 by threaded connections as common in the art. The wear bushing 60 is supported on the tool 150 with the arms 160 in the extended condition engaging either the internal profile 64 of the wear bushing 60 or the internal recessed reliefs 206 of the adapter 200, as depicted here. (The recessed reliefs 206 can provide radial support of the wear bushing 60, preventing it from twisting or turning on the tool 150.) Using conventional running procedures on the rig, the wear bushing 60 is run in with the tool 150 on the drillstring 50 while the extend arms 160 support the wear bushing 60. Eventually, the wear bushing 60 is landed in the wellhead 40. As is typical, a landing shoulder on the wear bushing 60 lands on a landing shoulder in the wellhead, such as on a casing hanger of the wellhead 40 as shown in FIG. 11.

As noted, the pistons 180 are configured to engage the adapter 200 and/or the wear bushing 60 so that, when the wear bushing 60 is landed in the wellhead components 44 and 46, downward force of the tool 150 can be applied to the wear bushing 60 by engagement of the shoulders. This can help fit the bushing 60 in the wellhead components 44 and 46 so that the catch pins 61 in the pockets 63 on the bushing 60 engage in the internal profile of the housing 44. These pins 61 can be biased by springs and can be sheared with an upward force.

With the wear bushing 60 landed, the pistons 180 are actuated to a retracted condition on the tool 150 by actuating the apparatus 100 with remote communication. For example, actuating the apparatus 100 can involve: detecting a radio frequency identification tag with the apparatus 100; detecting a mud pulse with a mud pulse telemetry component of the apparatus 100; wedging the pistons 180 laterally by moving a shifter longitudinally in the apparatus 100; hydraulically moving the pistons 180 into the pockets 154; or performing some form of mechanical, hydraulic, and electric operation.

At this point, the pistons 180 are retracted into the pockets 154 as shown in FIGS. 16A through 17B, and the drillstring 50 and the tool 150 can be run in further through the wellhead 40 to perform the desired operations. Meanwhile, the pistons 180 remain retracted in the mandrel 151 so as to avoid issues with damage and wear.

Figure 18D:
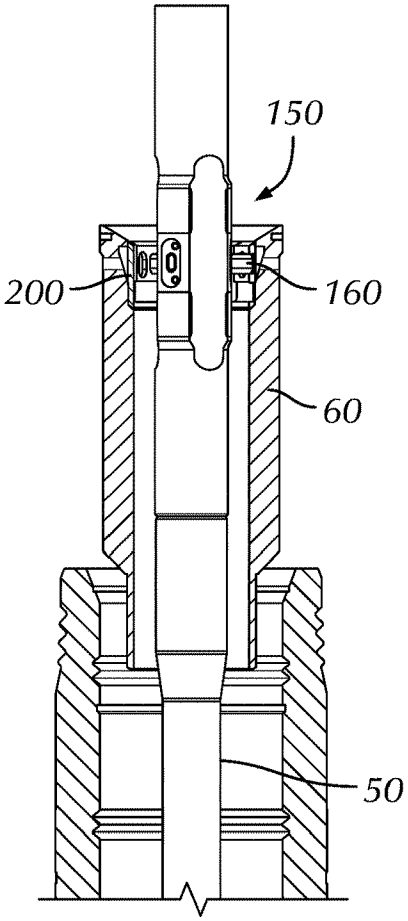
FIGS. 18A 18D illustrate cross-sectional views of the disclosed apparatus retrieving the wear bushing from the subsea wellhead.
Figure 18C:
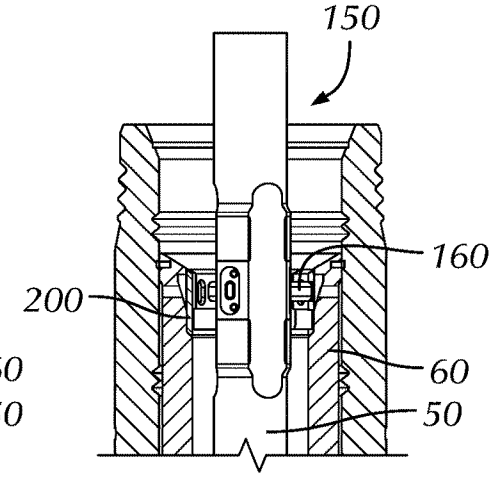
Figure 18B:
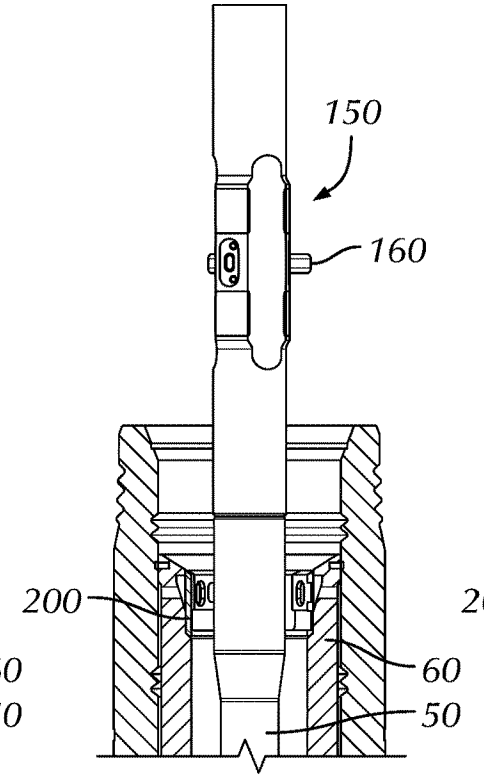
Figure 18A:
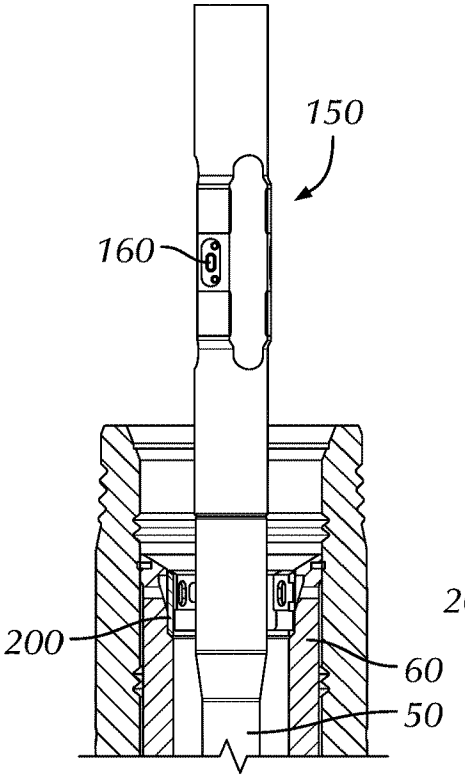

Eventually, the wear bushing 60 is to be retrieved from the wellhead 40 with the apparatus 100 on the drillstring 50. Turning to FIGS. 18A-18D, the disclosed apparatus 100 is shown during steps of retrieving the wear bushing 60 from the subsea wellhead 40. To retrieve the wear bushing 60, the tool 150 with the piston arms 160 retracted is pulled out on the drillstring 50 to a point uphole of the wellhead 40, as shown in FIG. 18A. The piston arms 160 are then extended from the retracted condition to the extended condition on the tool 150 by actuating the apparatus 100 with the remote communication, as shown in FIG. 18B.

The tool 150 is then run into the wear bushing 60 with the drillstring 50. As shown in FIG. 18C, the distal ends on the piston arms 160 pass into the J-latch profiles 208 of the adapter 200. Movement of the tool 150 then passes the piston arms 160 through the J-latch profiles 208 so that the arms' distal ends reach the inner extent of the profile 208.

Pulling up on the drillstring 50 can then engage contact shoulders of the piston arms 160 against the downward facing shoulder in the bushing's J-latch profiles 208. As shown in FIG. 18D, the wear bushing 60 is then pulled out from the wellhead 40 with the tool 150 by supporting the wear bushing 60 on the extended piston arms 160. As noted above, the wear bushing 60 may be initially held in the wellhead 40 with retaining pins 61. In this case, the drillstring 50 may be pulled up with over-pull to shear the retaining pins 61 to free the bushing for retrieval to surface. Because the wear bushing 60 may move or jostle during retrieval, the distal ends of the piston arms 160 can be sufficiently supported in both uphole and downhole directions inside the edges of the J-slot profile 208 of the adapter 200 (and the wear bushing 60).

While the apparatus 100 is activated, axial force from the drillstring 50 can be transferred to the internal profile 64 of the wear bushing 60 in order to pull the bushing 60 upward. Should excessive over-pull be seen when attempting to remove the wear bushing 60, the arms 160 can be retracted and the tool 150 and drillstring 50 removed from the wellbore. A separate trip with another tool can then be made to retrieve the wear bushing 60.

Figure 19A:
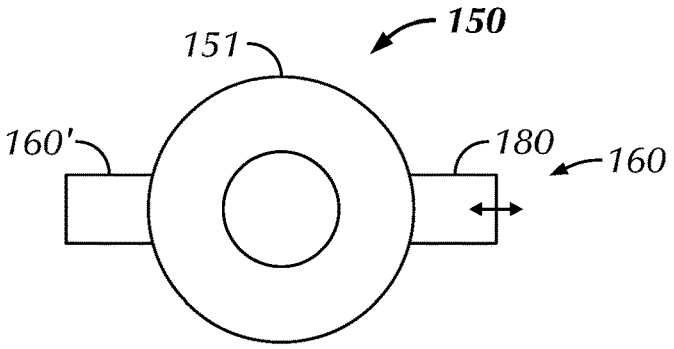
FIGS. 19A-19C illustrate alternative arrangements for the disclosed apparatus.

In previous arrangements, more than two arms 160 have been disposed about the circumference of the tool 150 and have been movable. In general, the tool 150 can use one or more arms 160 that are movable. As briefly shown in FIG. 19A, for example, one arm 160 in the form of a movable piston 180 can be used on one side of the mandrel 151 and can be movable between retracted and extended conditions to support inside one side of the through-bore (62) of the wear bushing (60). A fixed arm 160' or portion of the tool's mandrel 151 can be used as another non-movable arm to support/engage inside an opposing side of the through-bore (62) of the wear bushing (60). Alternatively, two opposing movable arms 160 as pistons 180 can be used on opposing sides of the mandrel 151 with ends for supporting/engaging inside the through-bore (62) of the wear bushing (60). Preferably, however, three or more movable arms are used on the tool 150.

Figure 19B:
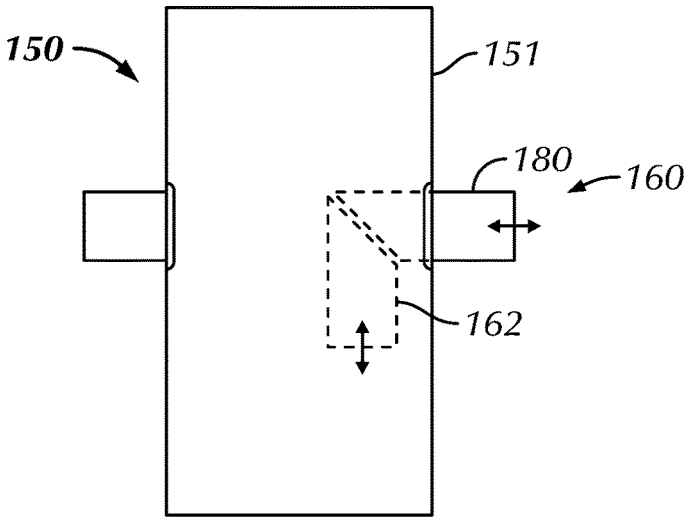

As noted above, the deployment/retrieval tool 150 can include arms 160 having pistons 180 actuated hydraulically. Other forms of pistons 180 and actuation can be used. As shown briefly in FIG. 19B, for example, the piston 180 of an arm 160 can have an inclined internal surface engageable by a complimentary inclined surface of a block or shifter 162 disposed on the mandrel 151. The shifter 162 can be movable longitudinally on the mandrel 151 between first and second positions using hydraulic or mechanical actuation to wedge the piston 180 between the retracted and extended conditions. Multiple pistons 180 can use a common block or shifter 162, or each of the pistons 180 can have a dedicated block or shifter 162 for it. An example configuration of shifters to wedge elements between extended and retracted conditions can be found in U.S. Pat. Pub. No. 2015/0101812, which is incorporated herein by reference.

To increase lateral reach of the pistons 180, the pistons 180 can use telescoping piston members for extending from the piston chamber of the pockets 154. The distal telescoping piston members can also include a catch 170 as discussed previously. For this arrangement, the mandrel 151 can have a hydraulic port for delivering/evacuating hydraulic pressure in the piston chamber to move the telescoping piston members. Retraction can be achieved using a spring or other arrangement.

Figure 19C:
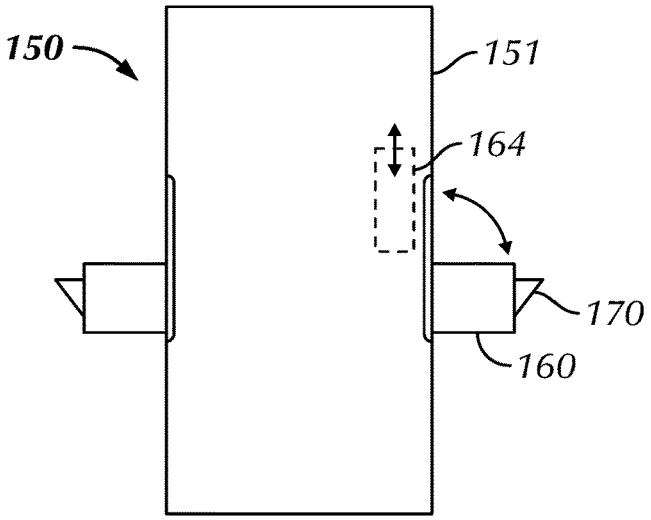

In contrast to pistons 180 actuated hydraulically or mechanically, other forms of arms 160 and actuation can be used. As shown briefly in FIG. 19C, for example, the arms 160 can have lever assemblies pivotably movable between the retracted and extended conditions in the mandrels' pockets 154. The lever arms 160 can have a lever member attached by a first pivot to the pocket 154 in the mandrel 151. The level member can be pivotable about the pivot between the retracted and extended conditions and can have a catch 170.

To move the lever member, a shifter 164 and a linkage arm (not shown) can be used. The shifter 164 can be disposed on the mandrel 151 and can be movable longitudinally thereon between first and second positions. The linkage arm (not shown) can be attached by a second pivot to the shifter 164 and by a third pivot to the lever member of the lever arm 160.

Instead of using a linkage arm to move the lever member, the shifter 164 disposed on the mandrel 151 and the lever member of the arm 160 can include a rack gear and a pinion gear engaged with one another so that movement of the shifter 164 to the first position pivots the lever member of the arm 160 in the retracted condition and movement of the shifter 164 to the second position pivots the lever member of the arm 160 in the extended condition. The disclosed tool 150 can use these and other forms of movable arms 160.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. An apparatus for deployment and retrieval of a wear bushing in a wellhead with a drillstring, the wear bushing having a through-bore, the apparatus comprising:

a mandrel coupled to the drillstring and disposed in the through-bore of the wear bushing, the mandrel defining a flowbore therethrough communicating with the drillstring, the mandrel having at least one pocket defined externally on the mandrel; and a plurality of arms disposed on the mandrel for supporting the wear bushing on the mandrel, at least one of the arms being selectively movable in the at least one pocket between a retracted condition in the at least one pocket and an extended condition at least partially out of the at least one pocket, a distal end of the at least one movable arm in the extended condition supporting the wear bushing at least in an uphole direction, wherein the distal end of the at least one movable arm comprises a catch biased to extend from the at least one movable arm, the catch on the at least one movable arm in the extended condition supporting the wear bushing.

2. The apparatus of claim 1, wherein the catch on the at least one movable arm in the extended condition supports the wear bushing in the uphole direction and retracts in the downhole direction.

3. The apparatus of claim 2, wherein the catch on the at least one movable arm in the retracted condition in the pocket recesses inside an external surface of the mandrel.

4. The apparatus of claim 2, wherein the catch comprises a first surface facing in the uphole direction and having a second surface facing in the downhole direction, the first surface supporting against an internal profile in the uphole direction with the catch biased to extend, the catch being retractable with the second surface engaged against in the downhole direction.

5. The apparatus of claim 1, wherein the at least one movable arm comprises a piston movable between the retracted and extended conditions.

6. The apparatus of claim 5, wherein the mandrel comprises at least a first hydraulic port for the piston, the piston comprising a first piston surface sealed in the pocket, the piston movable at least from a first of the extended and retracted conditions to a second thereof with first hydraulic communication from the at least first hydraulic port against the first piston surface.

7. The apparatus of claim 6, wherein the mandrel comprises at least a second hydraulic port for the piston, the piston comprising a second piston surface sealed in the pocket, the piston movable from the second of the extended and retracted conditions to the first thereof with second hydraulic communication from the at least second hydraulic port against the second piston surface.

8. The apparatus of claim 1, further comprising an actuator disposed on the apparatus and actuating the at least one movable arm to selectively move between the retracted and extended conditions.

9. The apparatus of claim 8, wherein the actuator is selected from the group consisting of a hydraulic actuator, a mechanical actuator, an electric actuator, an electro-mechanical actuator, and a combination thereof.

10. The apparatus of claim 8, wherein the actuator comprises a receiver receiving remote instruction to actuate the at least one movable arm in accordance therewith.

11. The apparatus of claim 8, wherein the actuator comprises one or more of a mud-pulse telemetry component, a radio-frequency identification component, a controller, a sensor, a timer, and a power source.

12. The apparatus of claim 1, wherein the distal end of the at least one movable arm directly engages portion of the wear bushing at least in the uphole direction.

13. The apparatus of claim 1, further comprising an adapter bushing disposed in the through-bore of the wear bushing, wherein the distal end of the at least one movable arm directly engages portion of the adapter bushing at least in the uphole direction.

14. The apparatus of claim 1, wherein the at least one movable arm comprises three or more of the at least one movable arm disposed circumferentially about the mandrel.

15. A method for using a wear bushing in a wellhead with a drillstring, the wear bushing having a through-bore, the method comprising:

deploying the wear bushing in the wellhead with the drillstring by:

installing an apparatus on the drillstring;

running in the wear bushing with the apparatus on the drillstring by supporting the wear bushing on a plurality of arms of the apparatus inside the through-bore of the wear bushing, a distal end of at least one of the arms comprises a catch biased to extend from the at least one arm, the catch on the at least one arm in an extended condition supporting the wear bushing;

landing the wear bushing in the wellhead with the apparatus on the drillstring;

retracting at least one of the arms movable from the extended condition to a retracted condition on the apparatus by actuating the apparatus; and running in the drillstring and the apparatus further through the wellhead; and retrieving the wear bushing from the wellhead with the apparatus on the drillstring.

16. A method for using a wear bushing in a wellhead with a drillstring, the wear bushing having a through-bore, the method comprising:

deploying the wear bushing in the wellhead on an apparatus with the drillstring; and retrieving the wear bushing from the wellhead by:

extending at least one movable arm of a plurality of arms from a retracted condition to an extended condition on the apparatus by actuating the apparatus;

engaging distal ends of each of the arms in a latch profile in the through-bore of the wear busing , the distal end of at least one of the arms comprising a catch biased to extend from the at least one arm, the catch on the at least one arm in the extended condition supporting the wear bushing; and pulling out the wear bushing from the wellhead with the apparatus on the drillstring by supporting the wear bushing on the distal ends of the arms of the apparatus.

17. An apparatus for deployment and retrieval of a wear bushing in a wellhead with a drillstring, the wear bushing having a first through-bore, the first through-bore defining a first profile therein, the apparatus comprising:

an adapter bushing supported on the wear bushing at the first profile, the adapter bushing having a second through-bore, the second through-bore defining a second profile therein, the second profile being different from the first profile;

a mandrel coupled to the drillstring and disposed in the second through-bore of the adapter bushing, the mandrel defining a flowbore therethrough communicating with the drillstring, the mandrel having at least one pocket defined externally on the mandrel; and a plurality of arms disposed on the mandrel and configured to engage the second profile of the adapter bushing for supporting the wear bushing on the mandrel, at least one of the arms being selectively movable in the at least one pocket between a retracted condition in the at least one pocket and an extended condition at least partially out of the at least one pocket, a distal end of the at least one movable arm in the extended condition configured to engage the second profile at least in an uphole direction.

18. The apparatus of claim 17, the first profile of the wear bushing having a first downhole-facing shoulder, wherein the adapter bushing comprise pins extending externally from the adapter bushing, the pins disposed in the first profile of the wear bushing and engaged against the first down-facing shoulder of the first profile.

19. The apparatus of claim 18, the first profile of the wear bushing having an uphole-facing shoulder, wherein the adapter bushing has a second downhole-facing shoulder engageable with the uphole-facing shoulder of the first profile.

20. The apparatus of claim 17, wherein the distal end of the at least one movable arm comprises a catch biased to extend from the at least one movable arm, the catch on the at least one movable arm in the extended condition engaging the second profile of the adapter busing to support the wear bushing.

21. The apparatus of claim 17, wherein the distal ends of the arms each comprise first uphole and downhole facing shoulders; and wherein the second profile of the adapter bushing comprises second uphole and downhole facing shoulders engageable with the first uphole and downhole facing shoulders.

22. The apparatus of claim 17, wherein the second profile of the adapter bushing defines a plurality of internal profiles in which the distal ends of the arms engage.

23. The apparatus of claim 22, wherein the internal profiles comprises one or more of a J-latch profile and a recessed relief in which each of the distal ends of the arms respectively engage.

24. The apparatus of claim 22, wherein each of the distal ends of the arms comprises first uphole and downhole facing shoulders engageable against second uphole and downhole facing shoulders in the internal profiles.

25. A method for using a wear bushing in a wellhead with a drillstring, the wear bushing having a first through-bore, the first through-bore defining a first profile therein, the method comprising:

installing an adapter bushing on the wear bushing by supporting the adapter bushing in the first through-bore of the wear bushing at the first profile, the adapter bushing having a second through-bore, the second through-bore defining a second profile therein, the second profile being different from the first profile;

installing an apparatus on the drillstring;

engaging a plurality of arms of the apparatus inside the second profile of the adapter bushing;

running in the wear bushing with the apparatus on the drillstring by supporting the wear bushing on the plurality of arms of the apparatus engaged inside the second profile;

landing the wear bushing in the wellhead with the apparatus on the drillstring;

retracting at least one of the arms movable from an extended condition to a retracted condition on the apparatus by actuating the apparatus, the at least one arm in the retracted condition disengaged from inside the second profile; and running in the drillstring and the apparatus further through the wellhead.

26. The method of claim 25, further comprising retrieving the wear bushing from the wellhead with the apparatus on the drillstring by engaging the arms of the apparatus inside the second profile of the adapter.

* * * * *